US011799212B2

(12) United States Patent
Saveri et al.

(10) Patent No.: US 11,799,212 B2
(45) Date of Patent: Oct. 24, 2023

(54) COLLINEAR ANTENNA ARRAY

(71) Applicant: MIRACH SAS DI ANNAMARIA SAVERI & C., Varese (IT)

(72) Inventors: Annamaria Saveri, Varese (IT); Sergio Lovisolo, Varese (IT); Simone Lovisolo, Varese (IT)

(73) Assignee: MIRACH SAS DI ANNAMARIA SAVERI & C., Varese (IT)

( * ) Notice: Subject to any disclaimer, the term of this patent is extended or adjusted under 35 U.S.C. 154(b) by 0 days.

(21) Appl. No.: 17/959,096

(22) Filed: Oct. 3, 2022

(65) Prior Publication Data

US 2023/0106893 A1 Apr. 6, 2023

(30) Foreign Application Priority Data

Oct. 4, 2021 (IT) ..... 102021000025382

(51) Int. Cl.
*H01Q 21/10* (2006.01)
*H01Q 23/00* (2006.01)

(52) U.S. Cl.
CPC ..... *H01Q 21/10* (2013.01); *H01Q 23/00* (2013.01)

(58) Field of Classification Search
CPC ..... H01Q 21/10; H01Q 23/00; H01Q 9/22
See application file for complete search history.

(56) References Cited

U.S. PATENT DOCUMENTS 2,199,375 A 4/1940 Lindenblad
3,159,838 A 12/1964 Facchine
4,963,879 A * 10/1990 Lin ..... H01Q 21/10 343/792
7,068,233 B2 * 6/2006 Thornberg ..... H01Q 9/0464 343/792
7,170,463 B1 * 1/2007 Seavey ..... H01Q 9/16 343/793

(Continued)

FOREIGN PATENT DOCUMENTS

CA 2659624 A1 * 2/2008 ..... H01Q 1/084
CN 115380637 A * 11/2022 ..... H01L 23/367

(Continued)

OTHER PUBLICATIONS

Search Report for IT Application No. 202100025382 dated Apr. 22, 2022, 2 pages.

*Primary Examiner* — Seokjin Kim
(74) *Attorney, Agent, or Firm* — NIXON & VANDERHYE P.C.

(57) ABSTRACT

It is disclosed an antenna array comprising a number of radiating elements and a supporting elongated flat printed circuit board (PCB) having a substrate and two opposite faces. Each radiating element is attached to the PCB; each radiating element is dipole-like and has a respective axis of symmetry; the axes of symmetry are aligned along a direction parallel to a longitudinal axis of the PCB and lie on a longitudinal plane parallel to a longitudinal center plane of the PCB and located between the opposite faces; the PCB comprises at least one conductive trace on one of the faces, the conductive trace acting as a ground plane; and for each radiating element, the PCB carries a respective feeding line to provide a feeding signal to the radiating element at a feed point located on the PCB and substantially belonging to the axis of symmetry.

9 Claims, 18 Drawing Sheets

(56) References Cited

U.S. PATENT DOCUMENTS

| | | | | |
|---|---|---|---|---|
| 7,365,698 | B2 | 4/2008 | Dwyer et al. | |
| 9,276,310 | B1 * | 3/2016 | Apel | H01Q 1/362 |
| 2003/0206140 | A1 * | 11/2003 | Thornberg | H01Q 19/00 343/890 |
| 2003/0234748 | A1 * | 12/2003 | Bateman | H01Q 21/10 343/852 |
| 2005/0110699 | A1 * | 5/2005 | Timofeev | H01Q 1/245 343/797 |
| 2007/0040758 | A1 * | 2/2007 | Dwyer | H01Q 21/062 343/792 |
| 2009/0195471 | A1 * | 8/2009 | Semonov | H01Q 1/246 343/810 |
| 2010/0188308 | A1 * | 7/2010 | Honda | H01Q 9/28 343/858 |
| 2012/0169560 | A1 * | 7/2012 | Lee | H01Q 9/30 343/770 |
| 2012/0188137 | A1 * | 7/2012 | Lalezari | H01Q 21/10 343/773 |
| 2017/0033472 | A1 * | 2/2017 | Motegi | H01Q 5/371 |
| 2017/0373385 | A1 * | 12/2017 | Alu | H01Q 15/0086 |
| 2018/0062731 | A1 * | 3/2018 | Ng | H01Q 21/30 |
| 2019/0229428 | A1 * | 7/2019 | Beskov | H05K 1/028 |
| 2019/0273326 | A1 * | 9/2019 | Sanford | H01Q 21/24 |

FOREIGN PATENT DOCUMENTS

| | | | | |
|---|---|---|---|---|
| CN | 115775971 | A * | 3/2023 | |
| EP | 0855760 | B1 * | 7/2001 | H01Q 21/10 |
| EP | 3534461 | A1 * | 9/2019 | H01Q 1/38 |
| JP | 1-206705 | | 8/1989 | |
| JP | 5371391 | B2 * | 12/2013 | H01Q 1/38 |
| KR | 20110129475 | A * | 12/2011 | H01Q 5/357 |
| WO | 2012/065421 | | 5/2012 | |
| WO | WO-2012065421 | A1 * | 5/2012 | H01Q 5/10 |
| WO | WO-2015147906 | A1 * | 10/2015 | H01Q 1/2291 |

* cited by examiner

COLLINEAR ANTENNA ARRAY

CROSS-REFERENCE TO RELATED APPLICATIONS

This application claims priority to IT Patent Application No. 102021000025382 filed Oct. 4, 2021, the entire contents of which are hereby incorporated by reference.

TECHNICAL FIELD

The present invention relates to the field of antennas. In particular, the present invention relates to a collinear antenna array for the VHF (Very High Frequency) or UHF (Ultra High Frequency) frequency band.

BACKGROUND ART

In aviation a Distance Measuring Equipment (DME) is a radio navigation system measuring the slant range (distance) between an aircraft and a ground station operating in the 960 MHz to 1215 MHz frequency band. For DME services, broadband omnidirectional antennas are currently used comprising a collinear antenna array of dipoles.

In the last decades, the technology of broadband collinear arrays of radiating elements proving an omnidirectional horizontal radiation pattern has greatly evolved.

Nowadays, the existing solutions are relatively heavy mechanical structures where both the radiating elements are metal (typically brass) cups, having a wide-diameter to increase the bandwidth of the antenna. Isolating chokes are typically placed at the top and bottom of the array, and if required they can also be present between adjacent radiating elements to increase their reciprocal isolation.

Radiating elements and chokes may have different shapes, but typically with a round section (cylindrical, conical, etc.). To avoid excessive fluctuations in the amplitude of the horizontal omnidirectional radiation pattern, they are coaxially mounted on a central supporting tube, and they are usually soldered to the same. The driven elements are parallel-fed via coaxial cables running inside the central supporting tube and exiting through holes or bulkheads on the side of the tube and near each radiating element.

The signals associated with each radiating element are processed by a signal splitter/combiner system. In the prior-art arrays, the signal splitter/combiner system is usually concentrated in a compact structure at the base of the antenna, or distributed with part of its elements placed inside the supporting tube.

For instance, U.S. Pat. No. 7,068,233 B2 discloses an integrated dual antenna system for Global Positioning System (GPS), Local Area Augmentation System (LAAS), ground based subsystem surface mounted (pole/tower/platform/other) and coaxially stacked (over and under). The dual antenna and receiver system is specifically designed and tuned to receive only the direct GPS satellite ranging signals while highly rejecting the ground multipath (indirect) signals. The upper antenna is a Right Hand Circularly Polarized (RHCP) omni-directional High Zenith Antenna (HZA) with dual obstruction lights and dual air terminals. The lower antenna is an electrically long vertically polarized omni-directional linear phased array having a very sharp horizon cut off and is a Multipath Limiting Antenna (MLA). When the two antennas (MLA and HZA) are mounted together they become the Integrated Multipath Limiting Antenna (IMLA). Interoperability is assured by high RF isolation between antennas. Both antennas are broad-band and have precisely controlled vertical and horizontal radiation patterns. Together the radiation patterns cover the complete upper hemisphere where satellites are visible.

U.S. Pat. No. 4,963,879 discloses an omindirectional antenna including one or more dipole radiators. Each dipole radiator comprises a first and second cylindrical radiating element. Each radiating element includes an end plate for mounting the radiating element coaxially on a tubular mast. The cylindrical radiating elements, end plates and tubular mast are all DC connected. A feed line is provided which may extend through the center of the mast and exit at an opening for connection to a secondary feed line. The secondary feed line is connected to an end of one of the cylindrical radiating elements of each pair of elements for each dipole radiator. The feed line is connected to the end of the cylindrical radiating element opposite the end plate. The configuration of the dipole radiators is such that the radiator functions as an RF choke for the adjacent radiators. An additional single cylindrical element can be provided at the end of a plurality of dipole radiators to provide RF choking for the immediately adjacent dipole radiator. A plurality of main feed lines may be included to extend through the center of the mast with corresponding openings for connection to secondary feed lines.

U.S. Pat. No. 2,199,375 discloses a short-wave aerial for radiating vertically-polarized waves of uniform field-strength in an horizontal plane consists of a series 1 . . . 4 of overlapping tapered half-wave tubes arranged coaxially about a common vertical axis 5 and energized in parallel from a feed-line TL. The comparatively-large diameter of the tubes gives the aerial a broad frequency-response. Each dipole is conductively connected at 6 to the supporting mast 5. The whole series is held in alignment by metallic rings 10 which are spaced so as to give maximum impedance between the upper and lower ends of each radiator, and also between the lower end of each radiator and the supporting mast. The transmission line is split into two main branches 11, 12 which are again sub-divided at 13 . . . 16. The outer sheath of each branch-line is connected to the mast 5, whilst the centre conductor is attached at 18 to each of the radiators. The dipoles may be aligned in an horizontal instead of a vertical plane.

U.S. Pat. No. 3,159,838 discloses vertically stacked hollow dipoles conductively supported on a mast.

U.S. Pat. No. 7,365,698 discloses a method of manufacturing a dipole antenna comprises the steps of forming first and second radiating elements on the surface of a flexible substrate, the radiating elements including respective feed points for making operative electrical contact with a feed line including corresponding first and second feed conductors. The radiating elements are arranged on the substrate such that, in use, an input impedance of the dipole antenna is substantially matched to a characteristic impedance of the feed line over a selected frequency band. The flexible substrate is then formed into a substantially cylindrical shape. The resulting antenna comprises an integral dipole antenna member having radiating elements disposed on a surface of a substantially cylindrical substrate.

WO 2012/065421 A1 discloses a broadband and dual-band omni-directional antenna with high performance. The antenna is characterized in that it includes a printed circuit board (PCB), a metallic cylinder resonator and a microstrip omni-directional resonator, wherein the microstrip omni-directional resonator is placed within the metallic cylinder resonator; two half-wave resonators placed in parallel are set in the microstrip omni-directional resonator, wherein a metallic microstrip ground line connected with the metallic cylinder resonator exists between the two half-wave resonators, and the microstrip omni-directional resonator and the metallic microstrip ground line are in the same plane of the PCB.

JP H01 206705 A discloses a primary radiating element to be composed of the metal-covered film formed on the surface of a substrate which is composed of a conductor. The lower edge part of the primary radiating element is connected through a ribbon-shaped conductor and an impedance matching element to a feeding terminal. A secondary radiating element to be composed of the cylinder-shaped conductor, whose both edges are opened, is provided so as to cover the surface of the primary radiating element. The shaft length of the secondary radiating element is formed to be suitably shorter than the ½ of a wavelength.

U.S. Pat. No. 7,170,463 B1 discloses broadband omnidirectional, vertically polarized communications antenna systems. The antenna systems comprise a plurality of center-fed stacked dipole radiating elements disposed along a central axis, a coaxial feed line coupled between each of the stacked radiating elements.

US 2009/195471 A1 discloses a broad beam width antenna array, preferably having 360 degrees of azimuth coverage, which also has broad frequency bandwidth, for use in a wireless network system. In a preferred embodiment the antenna array comprises a planar dielectric substrate, micro strip elements on both sides of the dielectric substrate, and a feed structure employing parasitic conductive beam width enhancing tubes as feed line conduits. The antenna array comprises dipole radiating elements formed on both sides of the dielectric substrate and a balanced feed network feeding each dipole arm. The shape of the dipole is symmetric and the overall structure, including feed network, preferably has a Γ-shape when viewed from either side of the dielectric substrate. Disposed proximate to each dipole arm are bandwidth enhancement coplanar micro strips which are parallel to each dipole arm and at least partially overlapping each other.

SUMMARY OF THE INVENTION

It is known that the vertical radiation pattern of antenna arrays such as the MLA antenna array disclosed in U.S. Pat. No. 7,068,233 B2 depends on the number of the radiating elements, the distance between them and the relative phases and amplitudes of the driving signals. The horizontal radiation pattern is in practice distorted by the presence of the central metal support tube. In fact the central metal support tube contains a RF power/phase coax transmission line system providing lateral feeds that can be either symmetrical or non-symmetrical. With symmetrical feeds, the driven element of each half wavelength dipole may be fed at two (see for instance U.S. Pat. No. 4,963,879) or four (as in U.S. Pat. No. 7,068,233 B2) equally spaced points around its open end circumference, while with non-symmetrical feeds the driven element is fed at one side of the open end circumference (as shown for instance in U.S. Pat. No. 2,199,375, in U.S. Pat. No. 3,159,838 and in U.S. Pat. No. 7,365,698). In any case, the feed points are far from the ideal axial symmetry center of the radiating element. This causes a non-uniform spreading of the longitudinal currents along the dipole's arms resulting in a radiation pattern on the azimuth plane having an irregular amplitude.

The Applicant has tackled the problem of providing a collinear antenna array having improved performances in terms of the amplitude uniformity of the radiation pattern on the azimuth plane.

According to the present invention, this problem is solved by providing a collinear antenna array without a central supporting tube and in which each radiating element is fed at a position near to its axial symmetry center. In particular, the antenna array of the present invention comprises a number of dipole-like radiating elements attached to an elongated flat supporting Printed Circuit Board (PCB). The axes of simmetry of the radiating elements are aligned along a direction parallel to a longitudinal axis of the supporting PCB. The axes of symmetry of the radiating elements, in particular, lie on a longitudinal plane parallel to a longitudinal center plane of the PCB and located between the two opposite faces of the PCB. The radiating elements are fed in parallel at respective feed points on the supporting PCB. Each feed point is located on the PCB at a position that substantially belongs to the axis of symmetry of the respective dipole.

In the following description and in the claims, the expression "a feed point" will indicate a position where the radiating element is attached to the supporting PCB and connected to an individual feeding line (which will be referred to also as "dipole feeding line") carrying the feeding signal. In particular, according to embodiments of the present invention, the feed point comprises, on each face of the PCB, a respective bonding pad at which the radiating element is soldered to the PCB.

The expression "the feed point substantially belongs to the axis of symmetry of the dipole" means that the position, on the PCB, of the feed point is at a distance from the axis of symmetry of the dipole which is equal to the distance between the plane where the axes of symmetry of the radiating elements lie and a face of the PCB. Considering the longitudinal center plane of the PCB as the plan where those axes of symmetry lie, this distance is about half the thickness of the PCB.

For feeding purposes, all the radiating elements are connected to a Splitting/Combining Network (SCN).

In particular, the present invention relates to an antenna array comprising a number of radiating elements and a supporting elongated flat printed circuit board having a substrate and two opposite faces, wherein:

- each radiating element is attached to the supporting printed circuit board;
- each radiating element is a dipole-like radiating element having a respective axis of symmetry;
- the axes of symmetry of the radiating elements are aligned along a direction parallel to a longitudinal axis of the supporting printed circuit board and lie on a longitudinal plane parallel to a longitudinal center plane of the printed circuit board and located between the opposite faces;
- the supporting printed circuit board comprises at least one conductive trace on one of the faces, the conductive trace acting as a ground plane for the radiating elements; and
- for each radiating element, the supporting printed circuit board carries a respective feeding line to provide a feeding signal to the radiating element at a feed point located on the printed circuit board and substantially belonging to the axis of symmetry.

Preferably, the substrate is made of a glass-reinforced epoxy resin.

Preferably, each radiating element comprises a driven element and a passive element, each of the driven element and the passive element being a conductive cylindrical element, wherein the driven element comprises a hollow cylindrical body, a top end cap and a bottom end cap, each of the top end cap and the bottom end cap having a respective slot to allow the passage of the supporting printed circuit board, the bottom end cap being soldered to the feed point at a position substantially corresponding to the center of the slot; and the passive element comprises a hollow cylindrical body and an end cap having a respective slot to allow the passage of the supporting printed circuit board.

According to a first embodiment of the present invention, the antenna array further comprises a splitting/combining network placed at a base of the antenna array, the spitting/combining network being connected to an antenna main port at the base of the antenna array and being configured to process an input signal from the antenna main port to provide respective signals to the radiating elements through individual dipole feeding lines.

Preferably, the dipole feeding lines are equal-length coaxial cables attached to the printed circuit board.

Preferably, the antenna array according to this embodiment further comprises, for each radiating element, a respective impedance-matching unit for matching a characteristic impedance of the coaxial cable to an impedance of the radiating element.

Preferably, the spitting/combining network is printed on a PTFE-based substrate.

According to a variant, the coaxial cables forming the feeding lines for the radiating element are split between the two faces of the supporting printed circuit board. In this case, the supporting printed circuit board has an overall layout which is formed by a number of adjacent sections of different, inverted (or alternating), layouts on the two faces of the substrate. Each section corresponds to a given number of radiating elements. Each coaxial cable runs over one face of the supporting printed circuit board and crosses the substrate close to the driven element of the respective radiating element. Thanks to this variant, the coaxial cables feeding the radiating elements of one sections run over one face while the coaxial cables feeding the radiating elements of the adjacent section run over the opposite face until each crosses the substrate close to the respective radiating element.

The substrate of the supporting printed circuit board may be made by a single slab supporting all the radiating elements of the antenna array. According to a variant, the substrate of the supporting printed circuit board is made of different slabs, which are connected together by means of, for instance, metal strips, each slab being configured to support a subset of adjacent radiating elements.

According to a second embodiment of the present invention, the antenna array further comprises a splitting/combining network printed on the supporting printed circuit board, the spitting/combining network being connected to an antenna main port at a base of the antenna array by means of a main feeding line printed on the supporting printed circuit board and being configured to process an input signal from the antenna main port to provide respective signals to feed the radiating elements through individual printed dipole feeding lines.

According to a third embodiment of the present invention, the antenna array further comprises a splitting/combining network printed on the supporting printed circuit board, the spitting/combining network being connected to an antenna main port at a base of the antenna array by means of a main feeding line comprising a coaxial cable attached to the supporting printed circuit board and being configured to process an input signal from the antenna main port to provide respective signals to feed the radiating elements through individual printed dipole feeding lines.

According to a fourth embodiment of the present invention, the splitting/combining network is printed on the supporting printed circuit board and split into at least a first section and a second section, the first section being connected to the main feeding line coming from the base of the antenna array, the second section being connected to the first section by means of a coaxial cable, wherein the first section is configured to provide respective signals to feed a first group of the radiating elements through individual a first group of printed dipole feeding lines and said second section is configured to provide respective signals to feed a second group of the radiating elements through a second group of individual printed dipole feeding lines.

BRIEF DESCRIPTION OF THE DRAWINGS

Further characteristics and advantages will become more apparent by reading the following detailed description of an embodiment given as an example with reference to the accompanying drawings, wherein.

DETAILED DESCRIPTION OF PREFERRED EMBODIMENTS OF THE INVENTION

In the present description and claims, unless otherwise specified, all the numbers and values should be intended as preceded by the term "about". Also, all ranges include any combination of the maximum and minimum points disclosed and include any intermediate ranges therein, which may or may not be specifically enumerated herein.

Figure 1B:
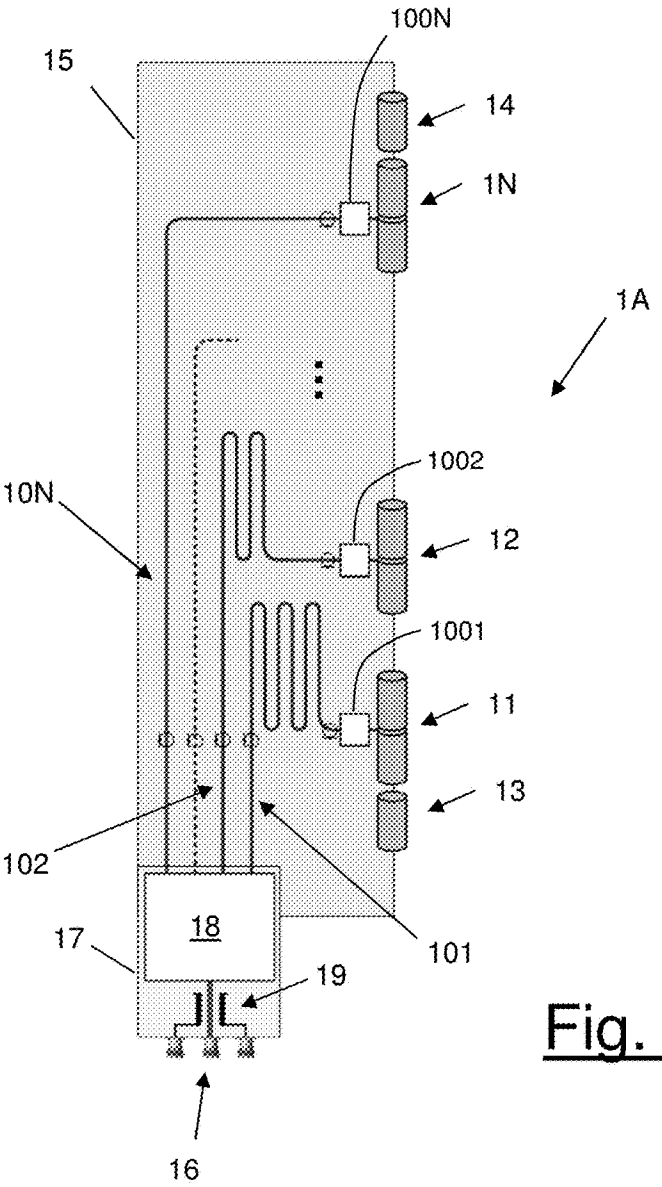
FIGS. 1*a* and 1*b* schematically show an antenna array according to a first embodiment of the present invention.
Figure 1A:
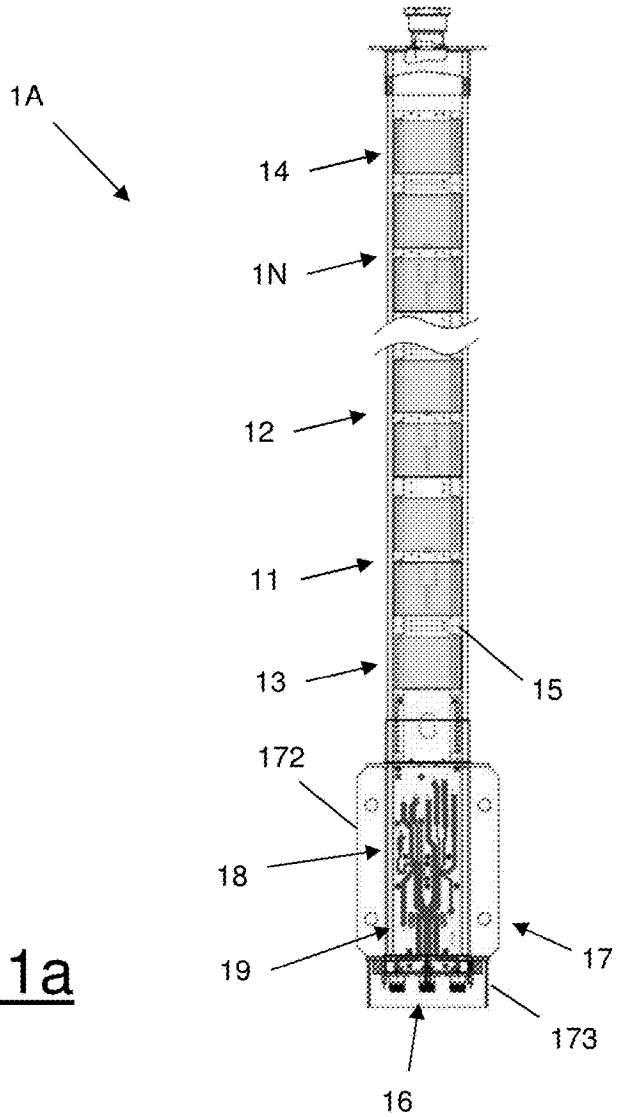

FIG. 1*a* schematically shows an antenna array 1A according to a first embodiment of the present invention. The components of the antenna array 1A will be briefly introduced here and described in greater detail herein after. FIG. 1*b* shows a block scheme of the antenna array 1A.

As shown in the Figure, the antenna array 1 comprises a number N of radiating elements 11, 12, . . . , 1N, where N is an integer number higher than 1, and preferably also isolating chokes 13, 14 that are placed at the top and at the bottom of the antenna array 1A. The radiating elements are dipole-like and will be referred to also as dipoles. As known, the more dipoles, the higher the gain, the narrower the vertical radiation pattern. The radiating elements 11, 12, . . . 1N have preferably a cylindrical shape with an axis of symmetry. The radiating elements 11, 12, . . . 1N and the isolating chokes 13, 14 are attached to an elongated supporting Printed Circuit Board (PCB) 15 extending for the whole antenna length and acting as a supporting structure. As schematically shown in FIG. 1, the PCB is preferably flat with two opposite faces. When the dipoles are assembled on the supporting PCB, their axes of symmetry are aligned along a direction parallel to a longitudinal axis of the supporting PCB and lie on a longitudinal plane parallel to a center plane of the supporting PCB and positioned between the two faces thereof. In particular, in the antenna array shown in FIG. 1, the axes of symmetry of the dipoles are aligned along the longitudinal axis of the PCB. The radiation elements 11, 12, . . . 1N and the isolating chokes 13, 14 are made with metal cups. The metal may be copper or brass. Isolating chokes can optionally be placed also between adjacent dipoles to increase their reciprocal decoupling.

Each radiating element is fed with a corresponding signal, in particular an RF (Radio Frequency) signal, carried by a respective feeding line (also referred to as "dipole feeding line").

In particular, the signals associated with each dipole 11, 12, . . . 1N (in other words, the signals used to feed the dipoles) are provided by a Splitting/Combining Network (SCN) 18 which processes an input signal coming from an antenna main port comprising an antenna connector 16 at the base 17 of the antenna array 1A. According to this embodiment, the SCN is a microwave microstrip (or stripline) circuit. This circuit may be printed on a microstrip (or stripline) substrate of a low-loss dielectric material, such as, for example, a PTFE (Polytetrafluoroethylene)-based substrate. The expression "low-loss dielectric material" indicates a substrate of a dielectric material with dissipation factor lower than about 0.0016 at 10 GHz. The SCN is designed to establish the relative phase (and amplitude, if required) of the signals associated with each radiating element. By suitably weighting these parameters of the feeding signals, the vertical radiation pattern of the array can be optimally shaped, with null-filling characteristics included. According to this embodiment, the SCN 18 is placed at the base 17 of the antenna array 1A. The input signal may also be processed by one or two optional directional couplers 19 (in printed microstrip or stripline technology) placed at the base of the antenna array. In case of transmitter operation, and if required by the specific application (for instance in airport DME applications), the one or two directional couplers can be used to monitor the signal that enters the SCN.

The radiating elements are then connected to the SCN via a number N of dipole feeding lines in the form of equal-length coaxial cables 101, 102, . . . , 10N running along the supporting PCB 15 in the center of the antenna structure. Each coaxial cable 10*i* (i=1, 2, . . . , N) comprises, as known, an inner conductor and a conducting shield. The shield of each coaxial cable is soldered to a ground plane of the PCB. The coaxial cables 101, 102, . . . , 10N may be of a semirigid or hand-formable type. Each coaxial cable is connected to a respective impedance-matching unit 1001, 1002, . . . , 100N comprising, e.g., a short printed line, for matching the characteristic impedance of the cable (typically 50 Ohm) to the impedance of the related dipole, as it will be described herein after.

This antenna array has a number of advantages, which will be clearer from the following description.

Firstly, the absence of a central tube allows to provide a feed point for each radiating element substantially at the element's longitudinal symmetry axis, as it will be described in greater detail herein after. Hence, a uniformly distributed current can flow longitudinally on the surface of the radiating elements, giving rise to a highly circular omnidirectional pattern around the longitudinal axis of the antenna array. This solution also reduces the production and manufacturing costs of the whole assembly and the overall weight of the antenna array. Moreover, the PCB can be made from a cheap epoxy resin based laminate (e.g. FR4 or similar), not having to carry long RF printed lines. The use of equal-length coaxial cables is a simplification and another cost-reduction element compared to the prior art solutions. Moreover, also the short extension of the impedance-matching unit associated with each coaxial cable allows it to be printed on the low-cost laminate because of the total reduced losses.

Figure 2B:
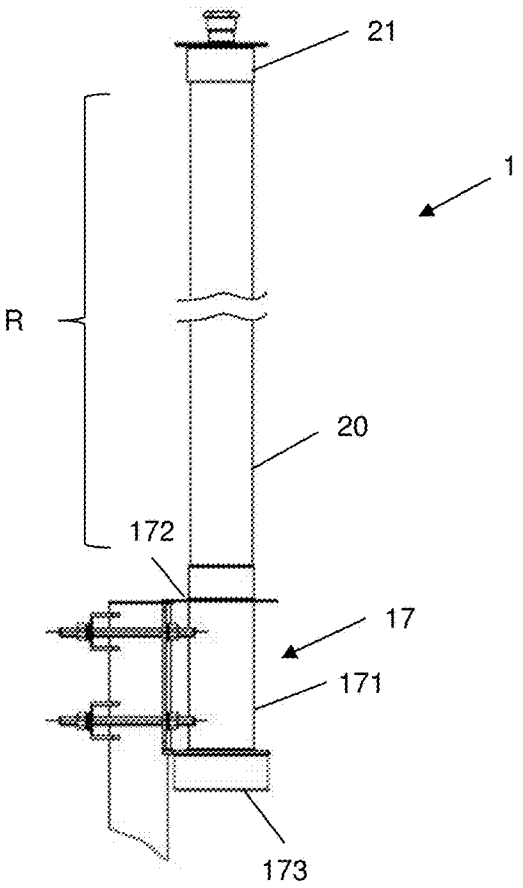
FIGS. 2*a* and 2*b* schematically show the mechanical structure of the antenna array according to an embodiment of the present invention, respectively with or without obstruction lights.
Figure 2A:
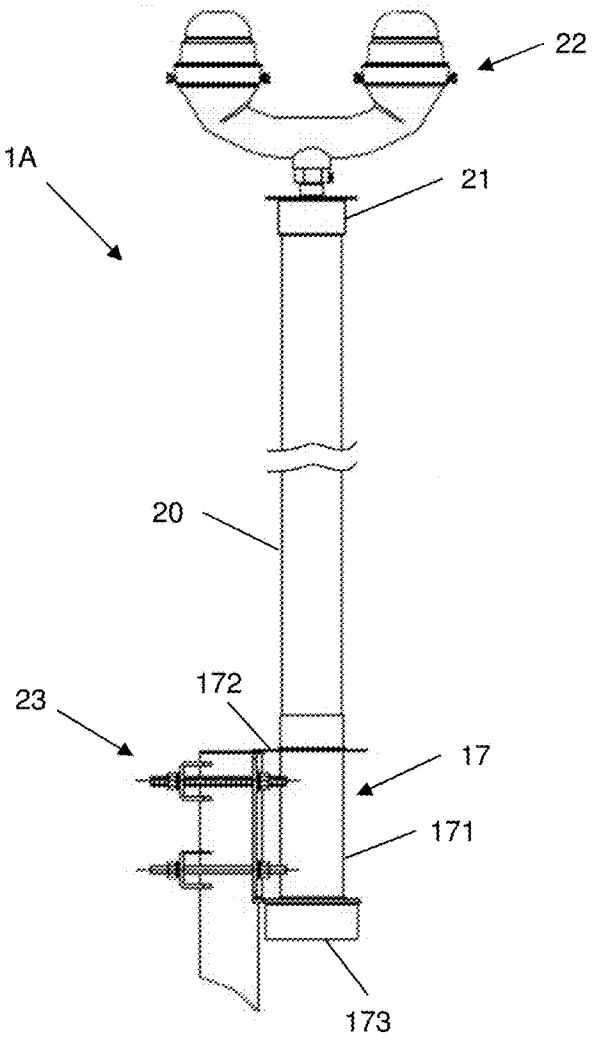

FIGS. 2*a* and 2*b* schematically show the mechanical structure of the antenna array 1A according to embodiments of the present invention, respectively with or without obstruction lights or lamps.

The antenna array 1A is weather protected and further supported by means of a cylindrical radome 20, for instance a polycarbonate (PC) tubular radome. It is terminated with a metal top cap 21, which can be secured to suitable wires (possibly non-conducting) to stabilize the structure. At the top of the antenna array 1A, one or two obstruction lamps 22 can be mounted, as schematically shown in FIG. 2*a*.

The base 17 of the antenna is a metal frame and is also a mechanical adapter for mounting the antenna to a supporting pole with two brackets 23 (as exemplarity shown in FIG. 2*a*), or directly against a flat surface. The base 17 of the antenna comprises the antenna connector 16, one or two optional additional connectors, in particular RF connectors (which are schematically shown in FIGS. 1*a* and 1*b* at both sides of the antenna connector 16), and a further optional connector for the obstruction lamps power supply. The optional additional RF connectors are connected to the optional directional couplers and may be used as monitoring ports.

The optional obstruction lamps 22 may be connected to the power supply connector by means of suitable wires.

The connectors are looking downwards, where they are protected against direct rainfall by means of a cylindrical shroud.

The length of the antenna array (indicated in FIG. 2*b* with reference letter "R") depends on the number N of dipoles used and on the operating frequency band. For example, an antenna array comprising ten dipoles and two obstruction lamps and operating around 1 GHz may have a total length of 2.27 m and a total weight of 14.5 Kg. Without the obstruction lamps, the total length reduces to 2.06 m and the total weight to 12 kg.

Figure 3:
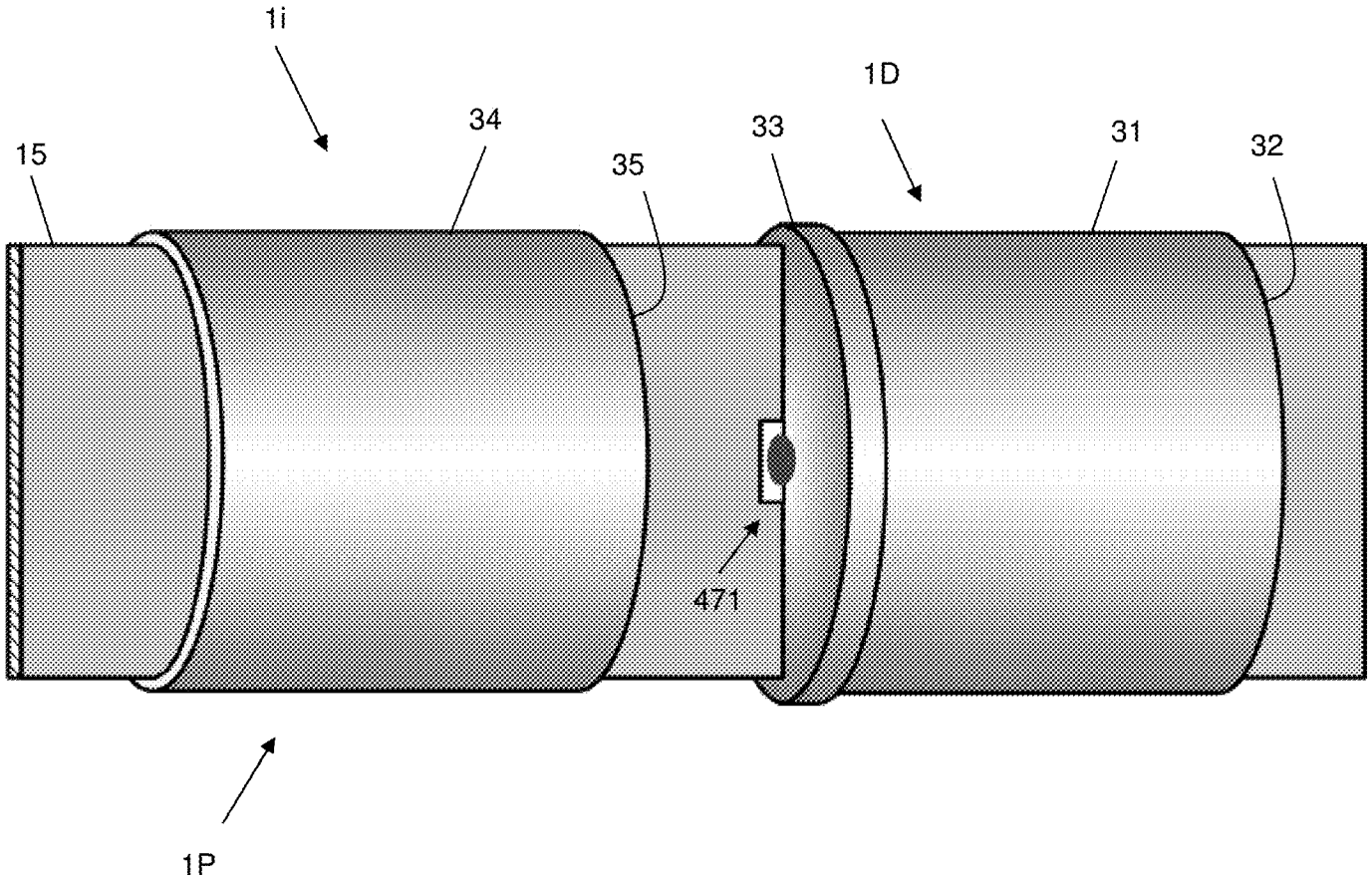
FIG. 3 schematically shows a single radiating element or dipole of the antenna array according to the invention.

FIG. 3 schematically shows a single radiating element or dipole 1*i* (i=1, 2, . . . , N) of the antenna array 1A according to the invention. Each dipole 1*i* comprises two conductive cylindrical elements, a driven element 1D and a passive element 1P. Both the conductive cylindrical elements of each dipole are secured to the supporting PCB 15.

The driven element 1D comprises a hollow cylindrical body 31 with two end caps, a top end cap 32 (not visible in FIG. 3) and a bottom end cap 33. The passive element 1P comprises a hollow cylindrical body 34 and one end cap 35 (not visible in FIG. 3). For each element, the material of both the cylindrical body and the end caps may be copper or brass. In particular, the cylindrical body is a thin metal tube with a thickness of a few tenths of mm. The end caps are soldered to the cylindrical body. The end caps are provided, substantially at their center, with suitable slots to allow the passage of the supporting PCB, of the coaxial cables feeding the dipoles and of the optional wires supplying current to the obstruction lamps, as it will be described in greater detail herein after. Each slot extends along a diameter of the end cap. Each slot may be obtained by punching the respective end cap. The elements of the dipole may be manufactured by embossing. In this case, the cylindrical body may be directly provided with one end cap. The required slot may be obtained by punch-through as part of the embossing process.

Figure 4A:
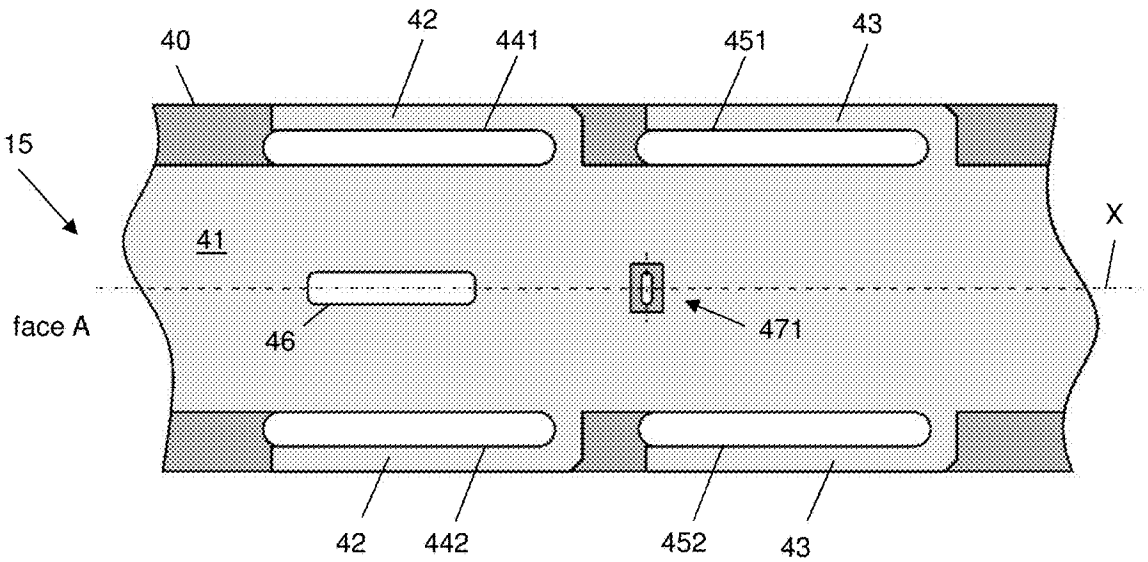
FIGS. 4*a* and 4*b* schematically show the two opposite faces (face A and Face B) of a portion of the supporting PCB.
Figure 4B:
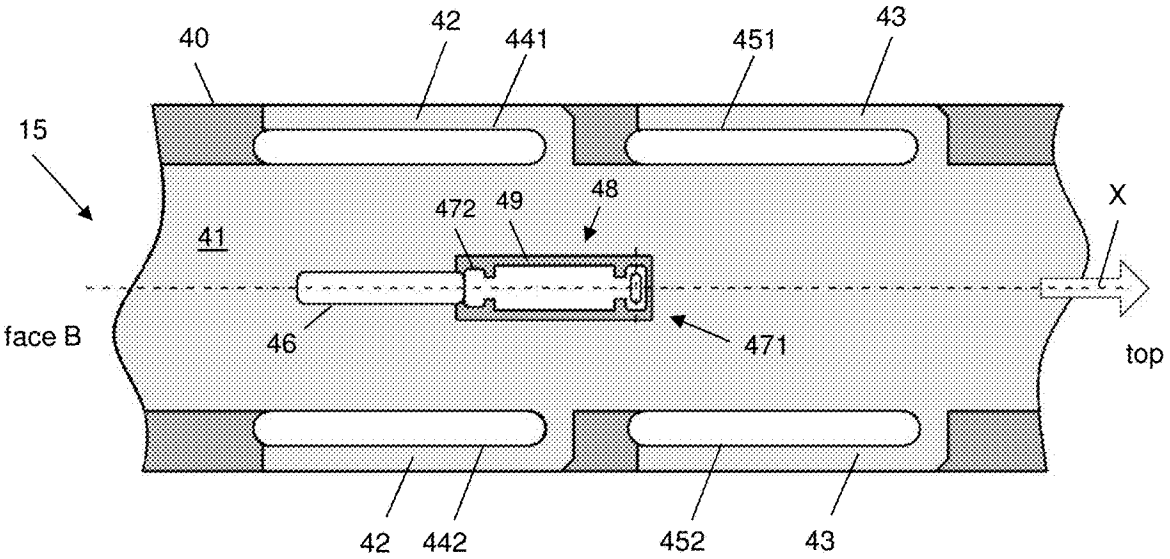

FIGS. 4*a* and 4*b* schematically show the two opposite faces (respectively, face A and face B) of a portion of the supporting PCB 15 corresponding to the area where the radiating element 1*i* is secured to the PCB 15. The dash-dotted line indicated by reference symbol "X" represents the axis of symmetry of the dipole 1*i*, which coincides with the longitudinal axis of the PCB. The arrow in FIG. 4*b* indicates the direction of the antenna array top side. The supporting PCB 15 comprises a substrate 40, which can be made of a standard glass-reinforced epoxy resin, such as FR4. Both faces of the supporting PCB comprises a central conductive trace 41, e.g. a copper trace, running longitudinally over the entire length of the PCB and acting as a ground plane on each face.

Moreover, for each radiating element 1*i*, each face of the supporting PCB 15 comprises two couples of L-shaped metal side traces 42, 43, e.g. made of copper, extending from the central metal trace 41 until the PCB boundaries and running along the sides of the PCB 15. Each couple of side traces 42, 43 is used as anchoring or soldering pads for a respective element 1P, 1D of the dipole 1*i*. FIG. 4*a* shows a first couple of L-shaped metal side traces 42 and a second couple of L-shaped metal side traces 43 on face A of the supporting PCB 15. In the scheme shown in FIG. 4*a*, the first couple of side traces 42 is used to solder the passive element 1P of the dipole 1*i*, while the second couple of the side traces 43 is used to solder the driven element 1D of the dipole 1*i*. Corresponding couples of L-shaped metal side traces are positioned on face B of the PCB, as shown in FIG. 4*b*, where they are indicated with the same reference numbers.

Similar elements are used to secure an isolating choke to the supporting PCB 15.

The portion of the supporting PCB schematically shown in FIGS. 4*a* and 4*b* also comprises two couples of slots (where a first couple of slots comprises a first slot 441 coupled to a second slot 442 and a second couple of slots comprises a third slot 451 coupled to a fourth slot 452), each couple of slots being associated with a respective element 1P, 1D of the dipole 1*i*. The first and third slots 441, 451 extends longitudinally at a first side of the supporting PCB, near its border. Analogously, the second and fourth slots 442, 452 extends longitudinally at a second side of the supporting PCB, near its border. These slots create air gaps that minimize losses (and parasitic capacitances) of the elements of the dipole. The considered portion of the supporting PCB also comprises a fifth slot 46 which extends along the longitudinal axis of the PCB and which is used as a passage for the coaxial cable that feeds the driven element 1D of the dipole 1*i*, as it will be described herein after.

Further, the considered PCB portion comprises, on both faces, a first bonding pad 471 (formed on both faces of the PCB by, e.g., a plated through-hole) which is surrounded by a metal-free area (the darker area around the through-hole in FIG. 4*a*). As it will be apparent from the description herein below, this pad is a feeding bonding pad for the considered dipole since it is used to feed the driven element of the dipole with the feeding signal carried by the respective dipole feeding line. Moreover, on face B, the considered PCB portion comprises the impedance-matching unit for the considered dipole 1*i* with an impedance-matching line 48 comprising, in particular, a microstrip line 49 connected, at one end, to the first bonding pad 471 and at the other end to a second bonding pad 472. The impedance-matching line 48 is designed to provide an impedance matching between the driven element impedance, which is typically less than 50 Ohm, and the coaxial cable characteristic impedance, which is usually 50 Ohm. Moreover, the second bonding pad 472 is suitably shaped to compensate for the mismatch due to the transition between the coaxial cable and the microstrip line 49.

In operation, the coaxial cable feeding the driven element 1D is running over face A of the supporting PCB, passing through the fifth slot 46 and then connected to the impedance-matching line on face B of the PCB. In particular, the inner conductor of the coaxial cable is soldered to the second bonding pad 472 of the impedance-matching line 48, while the conducting shield of the coaxial cable is soldered to the central metal trace 41 of the supporting PCB on both faces. This interconnection technique advantageously reduces the impedance discontinuities in the coaxial-to-microstrip junction point.

The central metal traces 41 of the two faces of the supporting PCB are preferably connected by means of a number of metallized via holes (not shown in the Figures). The number, shape and positioning of these via hole will not be further described herein after as it is known practice for a PCB.

As anticipated above, the driven element 1D of a dipole 1*i* is soldered to the supporting PCB at the soldering pads formed by the second couple of L-shaped metal side traces 43 on both faces of the PCB, in particular at the two portions of these L-shaped metal side traces between, respectively, the third slot 451 and the border of the PCB and the fourth slot 452 and the opposite border of the PCB. Similarly, the passive element 1P of the same dipole 1*i* is soldered to the PCB at the soldering pads formed by the second couple of L-shaped metal side traces 42 on both faces of the PCB, in particular at the two portions of these L-shaped metal side traces 42 between, respectively, the first slot 441 and the border of the PCB and the fourth slot 442 and the opposite border of the PCB.

It is to be noticed that each isolating choke is soldered to the PCB with soldering pads like those used for the dipole passive element.

With reference again to FIG. 3, the driven element comprises a top end cap 32 and a bottom end cap 33, both provided with suitable slots to allow the passage of the supporting PCB, of the coaxial cables feeding the dipoles and of the optional wires supplying current to the obstruction lamps. In particular, the wires supplying current to the obstruction lamps may be contained in a metal tube soldered to the ground plane of one face of the supporting PCB, to isolate and shield them, as further described herein after.

Figure 5A:
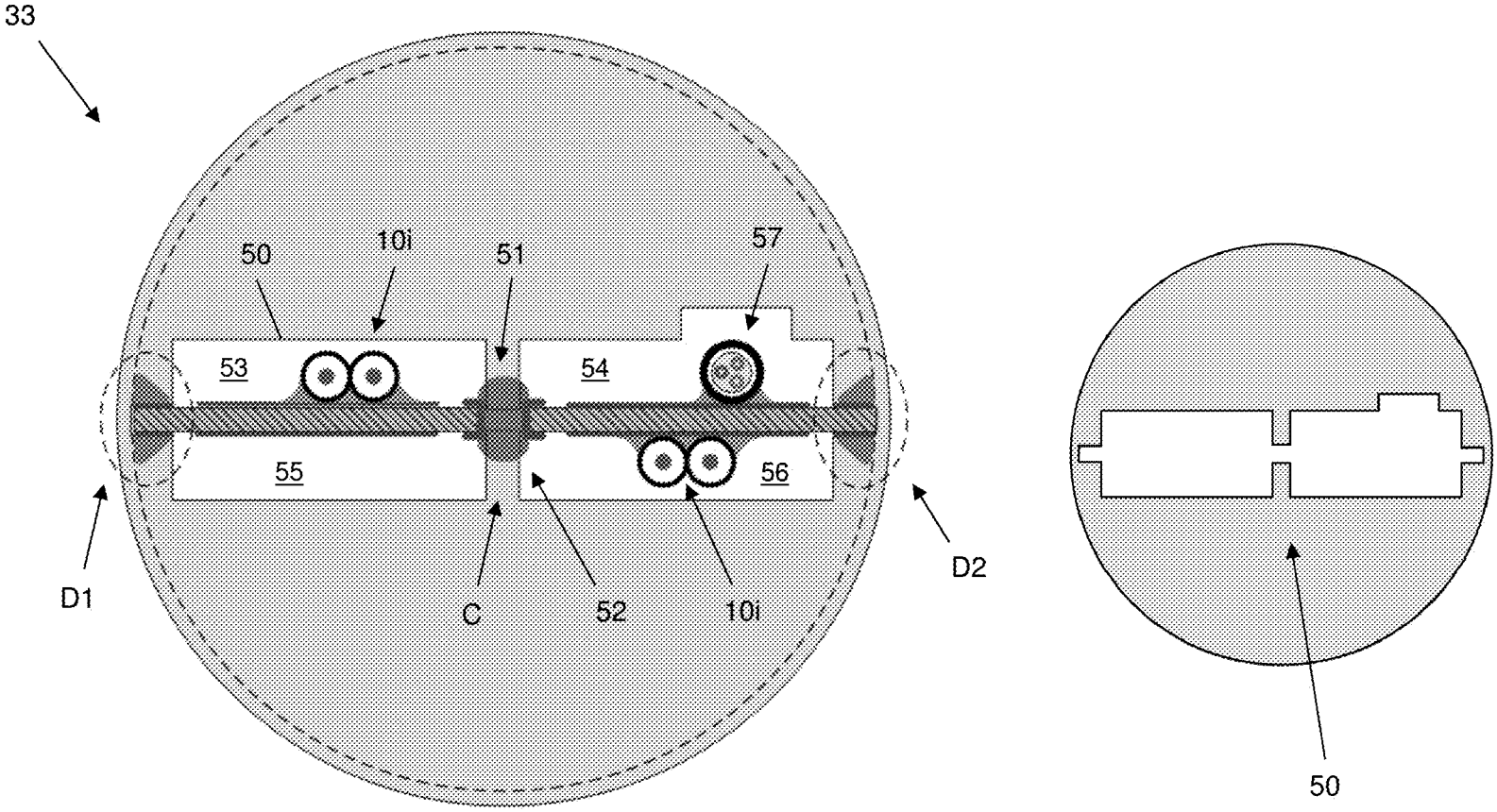
FIG. 5*a* schematically shows a transverse section of the bottom end cap of a driven element of a dipole according to an embodiment of the present invention.

The bottom end cap 33 of the driven element 1D is schematically shown in FIG. 5*a*. In particular, FIG. 5*a* shows a transverse section of the bottom end cap 33. The bottom end cap 33 comprises a slot 50 extending transversally with respect to the longitudinal axis of the dipole. The slot 50 is suitably shaped to allow the passage of the PCB. The shape of the slot 50 is better represented in the right side of FIG. 5*a*.

The bottom end cap 33 is soldered to the supporting PCB at a central position indicated with letter C in the Figure. In particular, it is soldered to the supporting PCB at the first bonding pad 471 described above. Soldering is performed by means of two opposite tabs 51, 52 placed substantially at the center of the bottom end cap 33 and protruding from the cap's surface at the two opposite borders of the slot 50, one used to solder bottom top end cap to face A of the PCB and the other used to solder the bottom end cap to face B of the PCB. In this way, the feed point of the dipole's driven element is advantageously placed substantially at the center of the bottom end cap. Moreover, the bottom end cap 33 is soldered to both faces of the supporting PCB (in particular, to the soldering pads cited above) at two diametrically opposed positions indicated with "D1" and "D2", as shown in FIG. 5*a*.

When assembled on the supporting PCB, the bottom end cap 33 of FIG. 5*a* has four remaining openings, indicated with reference number 53, 54, 55 and 56, of substantially rectangular shape for the passage of the coaxial cables feeding the dipoles and soldered to the PCB as already described above. The coaxial cables are indicated with generic reference number "10*i*" in FIG. 5*a*. In particular, the height of the opening indicated by reference number 54 in FIG. 5*a* is locally increased at a position where, optionally, a metal tube containing the wires supplying current to the obstruction lamps may be positioned. This optional metal tube is indicated in FIG. 5*a* with reference number 57. As illustrated in FIG. 5*a*, the shield of the coaxial cables 10*i* and the optional metal tube 57 may be soldered to the ground plane of the supporting PCB on both faces thereof within the slot 50.

Figure 5B:
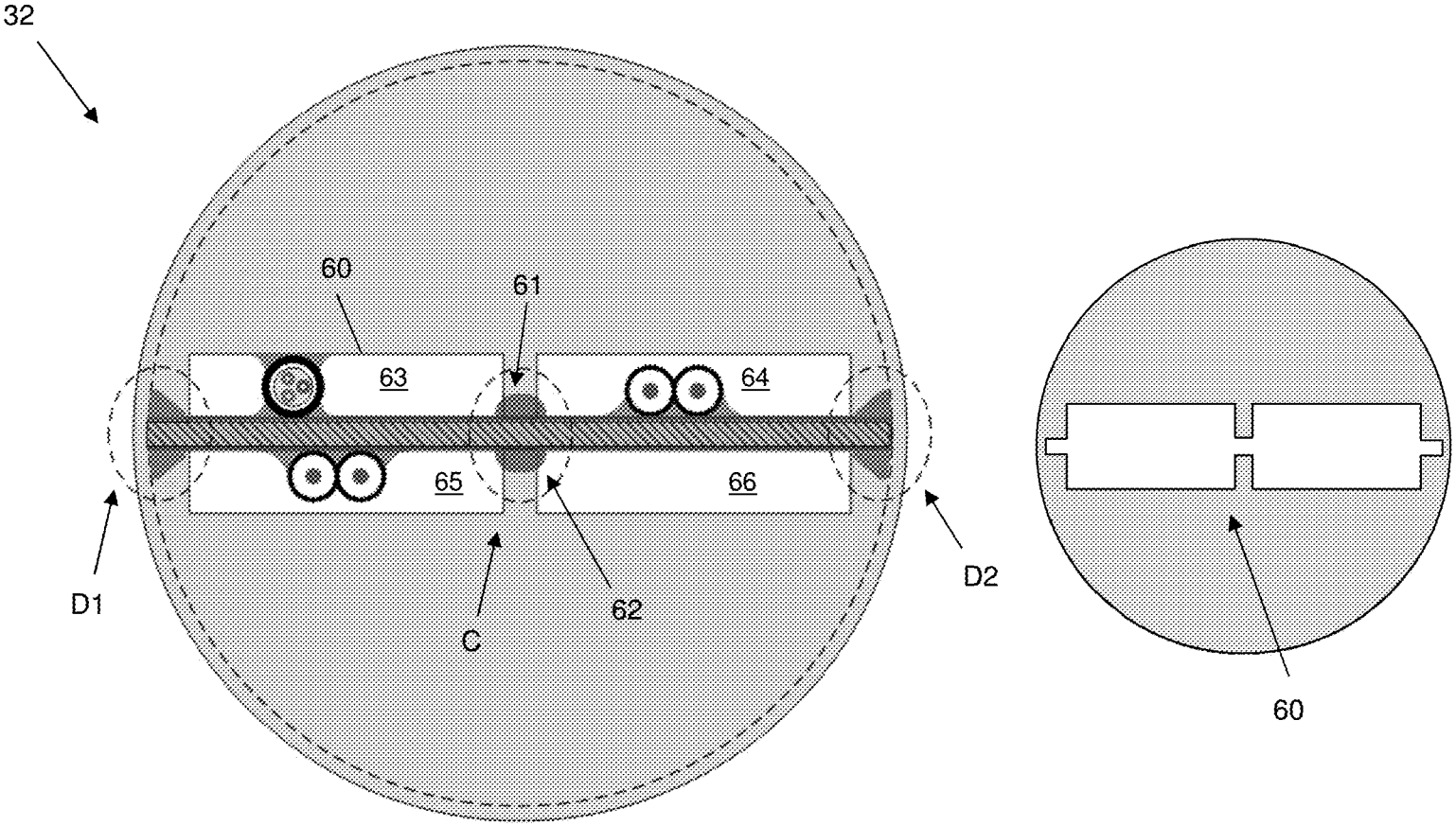
FIG. 5*b* schematically shows a transverse section of the top end cap of the driven element of a dipole according to an embodiment of the present invention.

The top end cap 32 of the driven element is schematically shown in FIG. 5*b*. The top end cap 32 comprises a slot 60 extending transversally with respect to the longitudinal axis of the dipole. The slot 60 is suitably shaped to allow the passage of the supporting PCB. The shape of the slot 60 is better represented in the right side of FIG. 5*b*.

The top end cap 32 is connected to the PCB ground plane on both faces thereof (in particular, to the soldering pads cited above) at two diametrically opposed positions D1 and D2, as shown in FIG. 5*b*. Moreover, it is also soldered to the ground plane of the supporting PCB at a position C substantially corresponding to the center of the top end cap by means of two opposite tabs 61, 62, one used to solder the bottom end cap to face A of the PCB and the other used to solder the bottom end cap to face B of the PCB.

When assembled on the supporting PCB, the top end cap 32 of FIG. 5*b* has four remaining openings 63, 64, 65, 66 of substantially rectangular shape for the passage of the coaxial cables feeding the dipoles and soldered to the PCB as already described above. If present, the metal tube containing the wires supplying current to the obstruction lamps is soldered to the top end cap of the driven element. As illustrated in FIG. 5*b*, the shield of the coaxial cables and the optional metal tube may be soldered to the ground plane of the supporting PCB on both faces thereof within the slot 60.

Figure 5C:
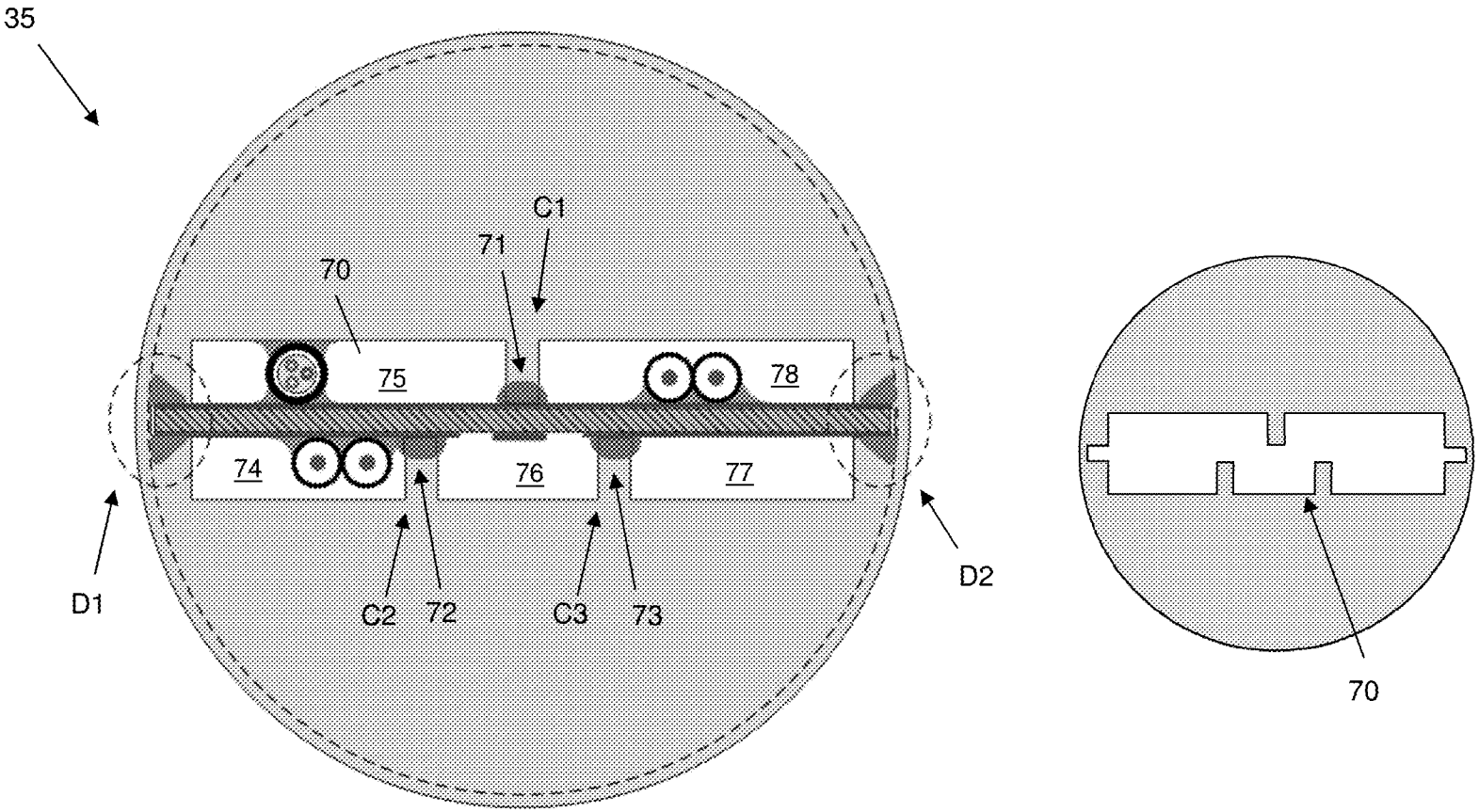
FIG. 5*c* schematically shows a transverse section of the end cap of a passive element of a dipole according to an embodiment of the present invention.

FIG. 5*c* schematically shows the end cap 35 of the passive element 1P of the dipole 1*i*. The end cap 35 comprises a slot 70 extending transversally with respect to the longitudinal axis of the dipole. The slot 70 is suitably shaped to allow the passage of the supporting PCB. The shape of the slot 70 is better represented in the right side of FIG. 5*c*.

This end cap is soldered to the ground plane of the supporting PCB on both faces (in particular, to the soldering pads cited above) at two diametrically opposed positions D1 and D2, as shown in FIG. 5*c*. Moreover, it is further soldered to the ground plane of the PCB at a number of positions near the center of the end cap, by means of respective tabs. In FIG. 5*c*, the end cap 35 is soldered to the PCB ground plane at three different positions in proximity of the center of the end cap, C1, C2 and C3. At these positions, one tab 71 is used to solder the end cap to face A of the PCB and the other two tabs 72, 73 are used to solder the end cap to face B of the PCB. In this particular embodiment of the present invention, two tabs 72, 73 are used on face B of the PCB to solder the end cap at two opposite positions with respect to the center of the PCB, where the impedance-matching line 48 is located. This way, the two tabs 72, 73 are soldered to the PCB ground plane at two opposite sides of the impedance-matching line 48.

When assembled on the PCB, the end cap of FIG. 5*c* has five remaining openings 74, 75, 76, 77, 78 of substantially rectangular shape for the passage of the coaxial cables feeding the dipoles and soldered to the PCB as already described above. If present, the metal tube containing the wires supplying current to the obstruction lamps is soldered to the top end cap of the driven element. As illustrated in FIG. 5*c*, the shield of the coaxial cables and the optional metal tube may be soldered to the ground plane of the supporting PCB on both faces thereof within the slot 70.

As mentioned above, isolating chokes are placed at the top and bottom of the antenna array, as schematically shown in FIG. 1. Both the top and bottom isolating choke are cylindrical elements with a cylindrical body. Each isolating choke has a single end cap similar to the end cap shown in FIG. 5*b*, which is connected to the PCB ground plane in a similar manner as described above with reference to the top end cap of the dipole's driven element.

Figure 6:
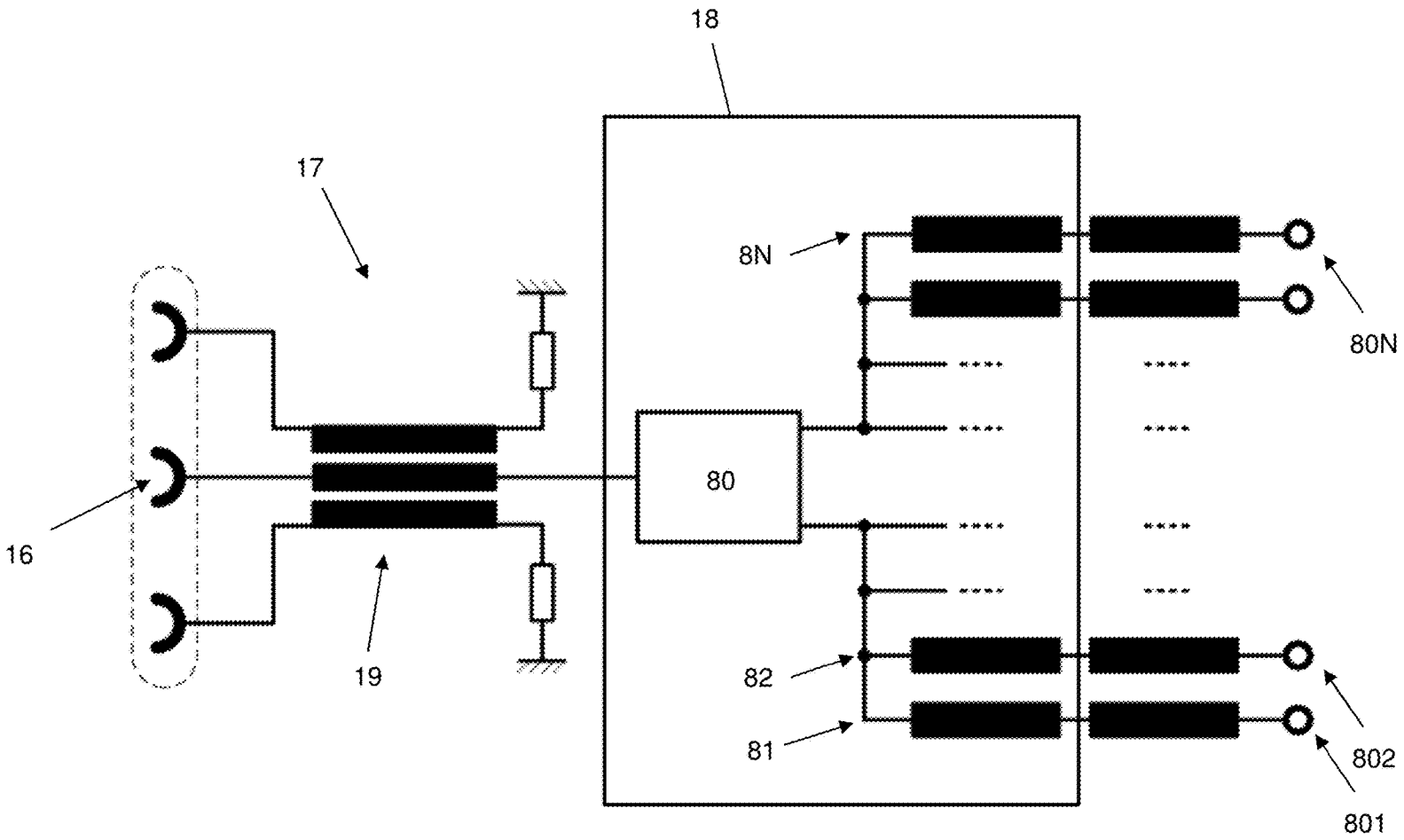
FIG. 6 schematically shows the splitting/combining network (SCN) of the antenna array according to the first embodiment of the present invention.

FIG. 6 schematically shows the splitting/combining network (SCN) of the antenna array 1A according to the first embodiment of the present invention. FIG. 6 also schematically shows the antenna connector 16 providing the input signal to the antenna array located at the base of the antenna array and the two optional directional couplers 19 connected to the antenna connector. The two directional couplers may be provided when the antenna array is used for e.g. DME applications, for power monitoring purposes.

The SCN represented in FIG. 6 preferably comprises a 3 dB splitter/combiner 80 connected, on one side, to the main line of the directional couplers 19 and, on the other side, to a number N of branches 81, 82, . . . , 8N comprising components providing amplitude and/or phase adjustment for the signals fed to the radiating elements. The SCN presents a number N of ports, each connected to a respective radiating element by means of a coaxial cable. All the N coaxial cables have the same length. Within the SCN, suitable weightings of the relative phases and/or amplitude of the signals are obtained according to known techniques that will not be described in detail herein after. The black rectangles shown in FIG. 6 on each branch of the SCN represent different sections of transmission lines with specific lengths and/or specific characteristic impedance for tuning the signal's phase and/or amplitude. This allows shaping the vertical radiation pattern of the antenna array.

Each coaxial cable 10*i* (I=1, . . . , N) is connected to the SCN as follows. The coaxial cables 10 lie on face A of the PCB with their shields soldered to the ground plane. The inner conductors of the coaxial cables 101, 102, . . . , 10N reach face B of the PCB passing through holes made into the substrate of the PCB. Then, they are soldered to anchoring pads provided at the boundary of the SCN (these anchoring pads are indicated in FIG. 6 with reference numbers 801, 802, . . . , 80N).

It is to be noticed that the shields of the coaxial cables 101, 102, . . . , 10N connecting the SCN to the radiating elements 11, 12, . . . , 1N are connected to the ground plane of the PCB on face A where they lie and to the ground plane of the PCB on face B at the positions of the slots allowing crossing of the PCB substrate for feeding the driven elements of the dipoles. On face A, the shield of each coaxial cable 10*i* (i=1, . . . , N) is preferably soldered to the ground plane of the PCB repeatedly, at a number of points regularly spaced over the ground plane. Similarly, also the optional metal tube carrying the wires supplying current to the obstruction lamps is soldered to the ground plane on face A of the PCB at a number of regularly spaced positions.

According to this embodiment of the present invention as described so far, each of the N coaxial cables 101, 102, . . . , 10N lies on face A of the PCB until it crosses the PCB in the proximity of the respective radiating element. In this case, the PCB can be formed on a single slab of substrate material supporting all the radiating elements of the antenna array. When the number N of radiating elements is relatively high and/or the PCB is narrow (which situation may correspond to operation of the antenna array at the highest frequencies of the UHF band), the coaxial cables may be split between the two faces of the supporting PCB. In such cases, the present invention provides for modifying the PCB as follows.

According to this variant, the supporting PCB has an overall layout which is formed by a number of adjacent sections of different, inverted (or alternating) layouts, as described herein after. Each section corresponds to a number of PCB portions, each portion corresponding to the portion shown in FIGS. 4*a* and 4*b*. Each section hence corresponds to an area where a number of radiating elements is secured to the PCB. This number may be for instance equal to two. However, the layout of the two faces of the supporting PCB in one section is inverted with respect to the layout of the two faces of the supporting PCB in the adjacent section. This means that, in one section, face A of the supporting PCB shows a first layout and face B shows a second layout, while in the adjacent section face A shows the second layout while face B shows the first layout.

Figure 7:
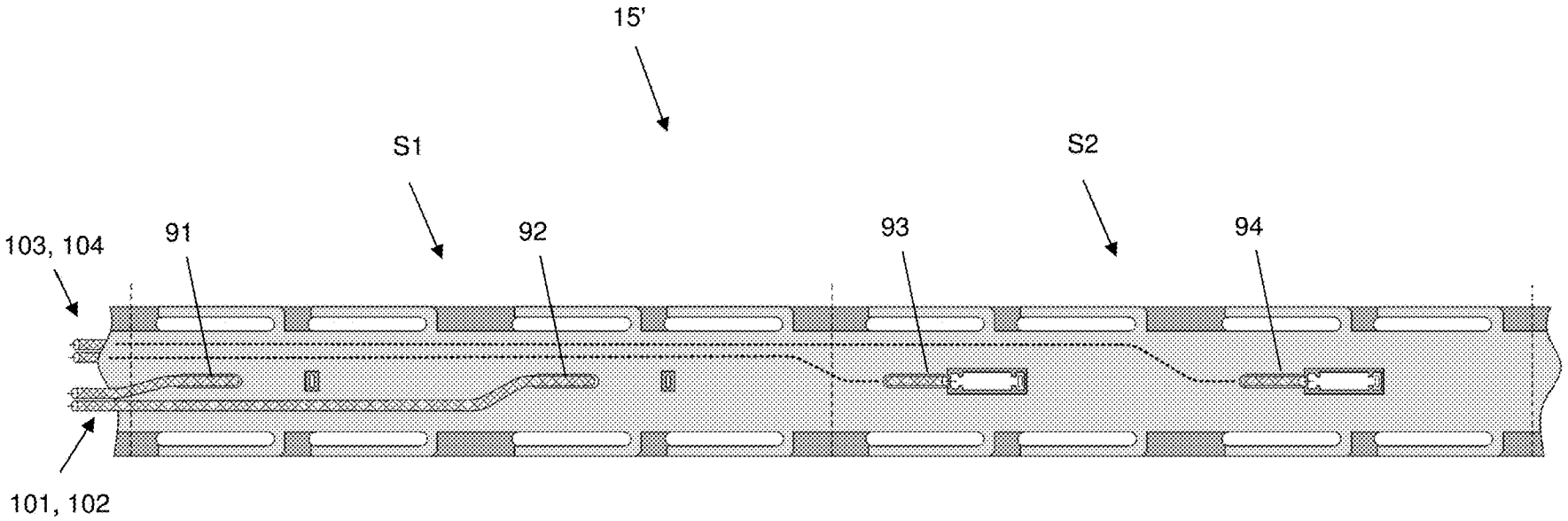
FIG. 7 schematically shows an exemplary layout of two different sections of face A of a supporting PCB according to a variant of the present invention.

FIG. 7 schematically shows an exemplary layout of two different sections of face A of a supporting PCB 15' according to this variant. As shown, a first section S1 presents the layout shown in FIG. 4*a* repeated two times. On face B (not visible), this section S1 comprises the layout shown in FIG. 4*b*. A second section S2 adjacent to the first section shows an inverted layout, which means that on face A it shows the layout of FIG. 4*b* repeated two times, while on face B (not visible) this section comprises the layout of FIG. 4*a*. As further shown in FIG. 7, two coaxial cables, indicated with exemplary reference numbers 101, 102, running over the first section S1 cross the supporting PCB in respective slots 91, 92, each slot corresponding, in a respective portion of the first section S1, to slot 46 shown in FIG. 4*a*. Each coaxial cable crosses the PCB in a position close to the driven element of the respective radiating element. The two coaxial cables 103, 104 running over the second section S2, emerge from respective slots 93, 94, each slot corresponding to, in a respective portion of the second section, slot 46 shown in FIG. 4*b*.

The above description refers to a PCB comprising a single slab of substrate material, which supports all the radiating elements of the array. According to a further variant, the supporting PCB may comprise different slabs of substrate material. Each slab comprises a number of PCB portions, each corresponding to the portion shown in FIGS. 4*a* and 4*b*. Each slab is hence configured to support a number of adjacent radiating elements (for instance, two). The PCB slabs are connected together, for instance by soldering metal strips to the ground planes of adjacent slabs and on both faces. In this case, the layout of the two faces of one PCB slab may be inverted with respect to the layout of the two faces of the adjacent PCB slab, as described herein above.

The base 17 of the antenna array is schematically shown in FIGS. 1*a*, 1*b* and 2*a*, 2*b*. It comprises a cylindrical body 171 made of a metal material (e.g. stainless steel) which houses the printed circuit board with the SCN 18 and optionally the directional couplers 19. Moreover, it comprises a rectangular plate 172 mounted on the surface of the cylindrical body 171 and made of the same material, which is used for securing the antenna array to a pole by means of a couple of brackets 23, or to a flat surface by means of screws. The bottom of the cylindrical body is closed by a circular cap 173 with a circular base plate housing the connector of the antenna main port and the other optional connectors for the monitoring ports and the supply for the optional obstruction lamps. The cap 173 may be surrounded by a shroud made of, preferably, stainless steel, to protect the connectors from direct rainfall.

Finally, the antenna base 17 comprises two beams of a metal material, e.g. aluminium, (not shown in the drawings) which are fastened to the circular base plate and attached to both sides of the substrate of the supporting SCN and to both sides of a first portion of the PCB carrying the radiating elements, for supporting purposes.

Figure 8A:
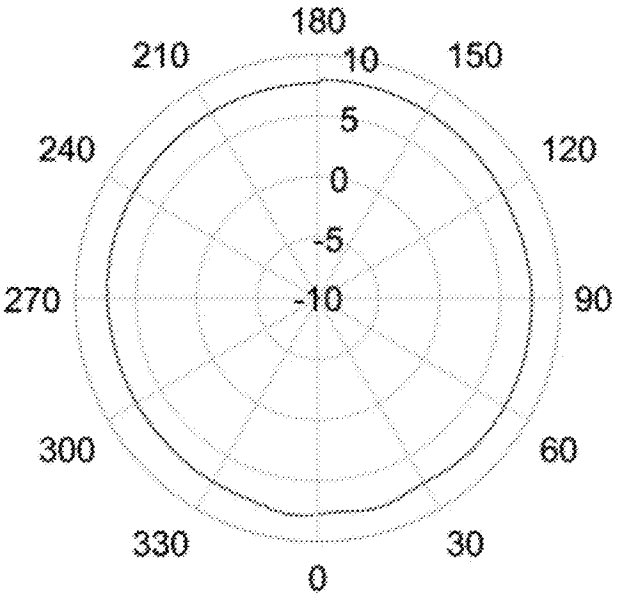
FIGS. 8*a* and 8*b* show, respectively, an horizontal gain pattern of a prototype antenna array in polar form and in a Cartesian graph.
Figure 8B:
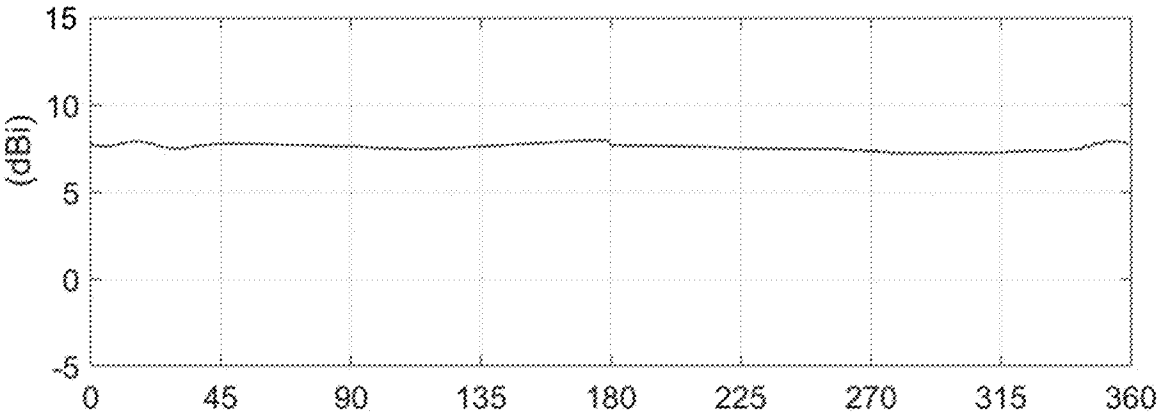

The inventors performed several measurements, in an anechoic chamber, of the radiation patterns of several prototypes of an antenna array according to the present invention comprising ten dipoles and operating in the 960 MHz-1215 MHz frequency band. FIG. 8*a* shows the horizontal radiation pattern of one of these prototype antenna arrays, in polar form. This pattern is measured at 1088 MHz. As clearly evident from this pattern, the gain of the antenna array over 360° has very small variations. FIG. 8*b* shows the gain at 1088 MHz in a Cartesian graph. The peak-to-peak fluctuations of the gain over 360° of azimuth range are measured to be from 0.5 dB to 0.8 dB, which are clearly very small values.

According to other embodiments of the present invention, the SCN is not concentrated at the base of the antenna but it is distributed over the length of the supporting PCB carrying the radiating elements. In particular, the SCN is printed on one face of the substrate as a microstrip (or stripline), while the other face of the substrate carries an extended ground plane. This advantageously allows to reduce costs with respect to the first embodiment, by significantly reducing the number of components and making the assembling process much simpler. In this case, the substrate of the PCB is a low-loss dielectric material, for instance a PTFE-based material.

Figure 9B:
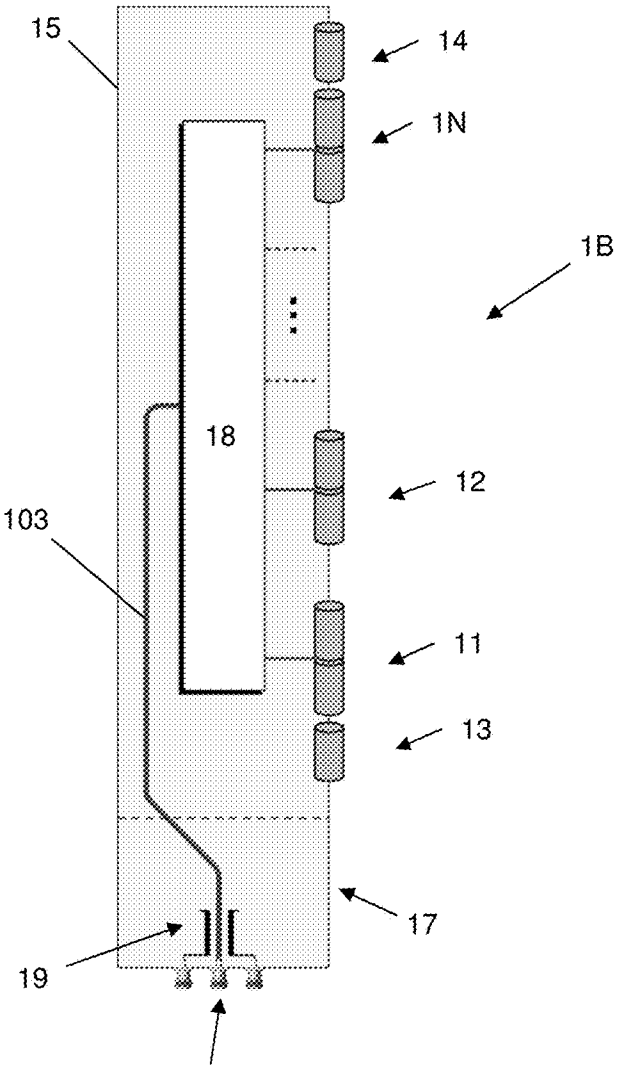
FIGS. 9*a* and 9*b* schematically show an antenna array according to a second embodiment of the present invention.
Figure 9A:
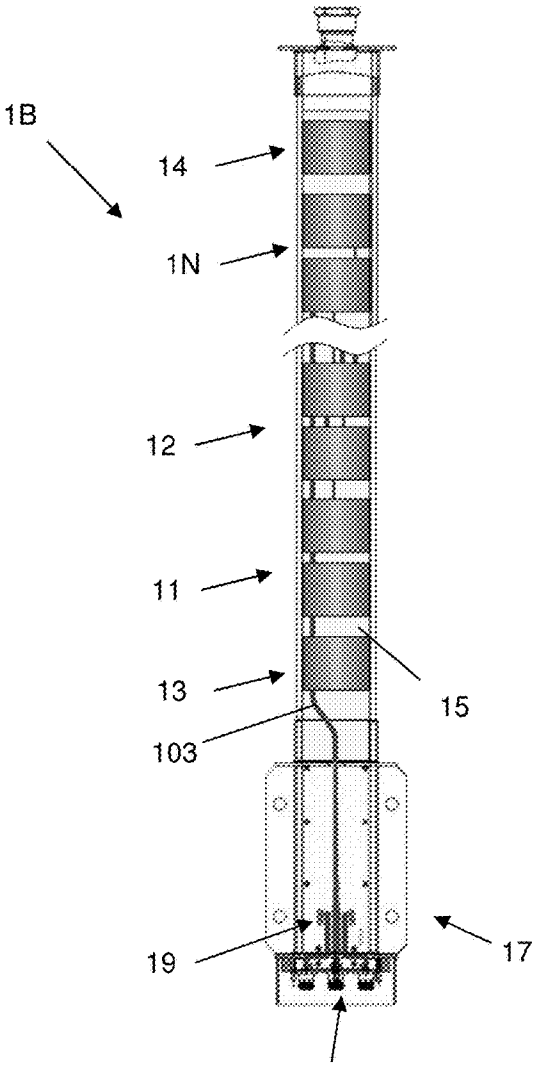

FIG. 9*a* schematically shows an antenna array 1B according to a second embodiment of the present invention. FIG. 9*a* shows a block scheme of the antenna array 1B. For sake of simplification, with respect to the antenna array 1A of the first embodiment, corresponding components will be indicated by the same reference numbers.

According to this embodiment, the supporting PCB of the antenna array comprises a printed distributed SCN 18 and a main feeding line 103 running from the antenna connector 16 at the base 17 of the antenna array to the center of the SCN. The distributed SCN 18, the optional directional couplers 19 and the main feeding line 103 are implemented as microstrip (or stripline) components. The branches of the SCN comprise printed dipole feeding lines reaching the individual radiating elements. Hence in this case, no coaxial cables are used, which advantageously reduces the complexity, cost and weight of the antenna array.

Figure 10B:
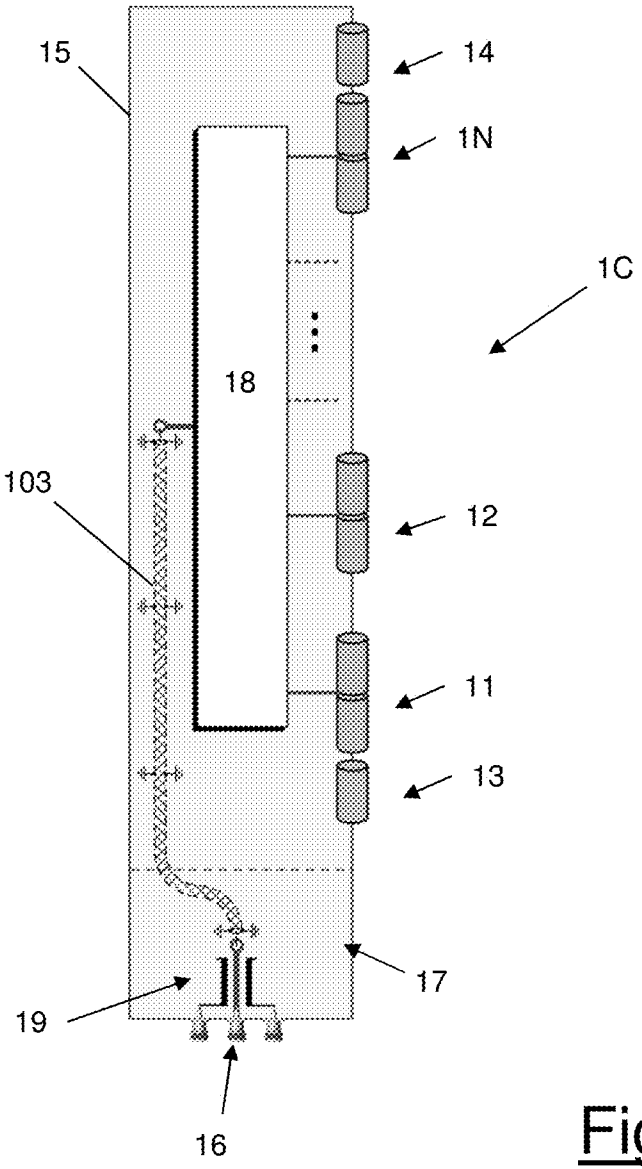
FIGS. 10*a* and 10*b* schematically show an antenna array according to a third embodiment of the present invention.
Figure 10A:
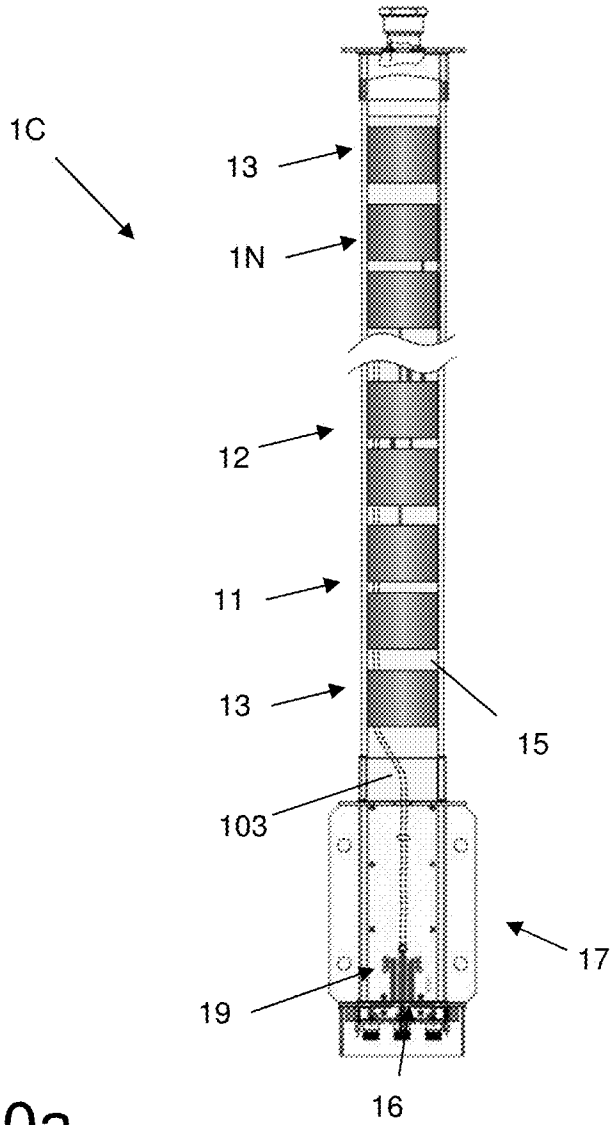

FIG. 10*a* schematically shows an antenna array 1C according to a third embodiment of the present invention. FIG. 10*b* shows a block scheme of the antenna array 1C. According to this embodiment, the antenna array 1C comprises the same components of the antenna array according to the second embodiment, namely, in particular, a supporting PCB comprising a printed distributed SCN 18 and a main feeding line 103 running from the antenna connector 16 at the base 17 of the antenna array to the center of the SCN. However in this case, the main feeding line is implemented as a coaxial cable. The coaxial cable 103 runs on one face of the supporting PCB 15, in particular on the face of the PCB 15 also comprising its ground plane (i.e. the face that is not visible in FIG. 10*b*), while the other face comprises the printed traces of the distributed SCN. The branches of the SCN comprise printed dipole feeding lines reaching the individual radiating elements. The shield of the coaxial cable is soldered to the ground plane of the supporting PCB, preferably at regular intervals. The coaxial cable may be of a semirigid or hand-formable type.

Figure 11:
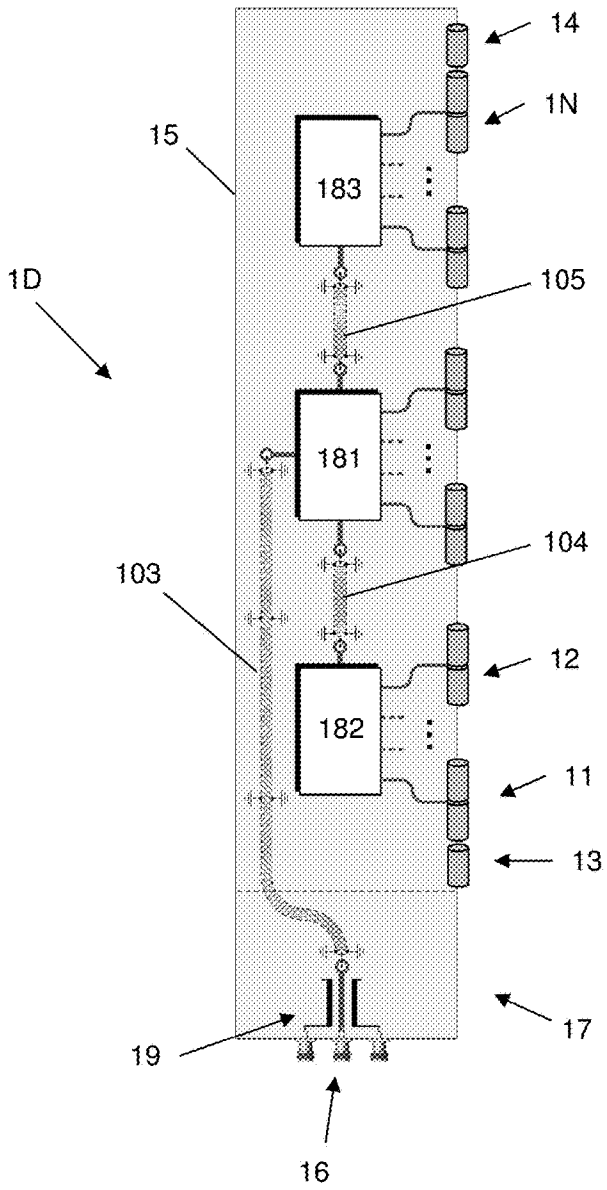
FIG. 11 schematically shows an antenna array according to a fourth embodiment of the present invention.

FIG. 11 schematically shows a block scheme an antenna array 1D according to a fourth embodiment of the present invention. According to this embodiment, the antenna array 1D comprises the same components of the antenna array according to any one of the second and third embodiment, i.e. a supporting PCB 15 comprising a printed distributed SCN and a main feeding line 103 running from the antenna connector 16 at the base 17 of the antenna array to the center of the SCN. Similarly to the third embodiment, the main feeding line 103 is implemented as a coaxial cable running on one face of the supporting PCB, in particular running on the face of the PCB comprising the ground plane (i.e. the face that is not visible in FIG. 11), while the other face comprises the printed traces of the distributed SCN. However, in this case, the distributed SCN is split into a number of sections, e.g. three sections, indicated in the Figure with reference numbers 181, 182, 183. Each section is configured to provide feeding signals to a respective group of the radiating elements through individual printed dipole feeding lines.

One first section 181 of the SCN is directly connected to the main feeding line 103 coming from the base of the antenna array, while the other SCN sections 182, 183 are connected to the first SCN section 181 by means of coaxial cables 104, 105, as it will be described in more detail herein after. All the coaxial cables may be of a semirigid or hand-formable type. All the coaxial cables run on one face of the PCB, in particular on one the face of the PCB comprising its ground plane (i.e. the face that is not visible in FIG. 11) while the other face comprises the printed traces of the distributed SCN. In each section, the branches of the SCN comprise printed dipole feeding lines reaching the individual radiating elements. The shields of the coaxial cables are soldered to the ground plane of the PCB, preferably at regular intervals.

In the following description, the components that are common to all the second, third and fourth embodiments will be described and the differences highlighted.

According to all these embodiments, the substrate of the supporting PCB carrying the radiating elements is, as anticipated above, a low-loss dielectric material. One face of the supporting PCB, i.e. face A, comprises the printed SCN and anchoring pads for the radiating elements, while the other face, i.e. face B, comprises the ground plane for the SCN and anchoring pads for the radiating elements.

Figure 12A:
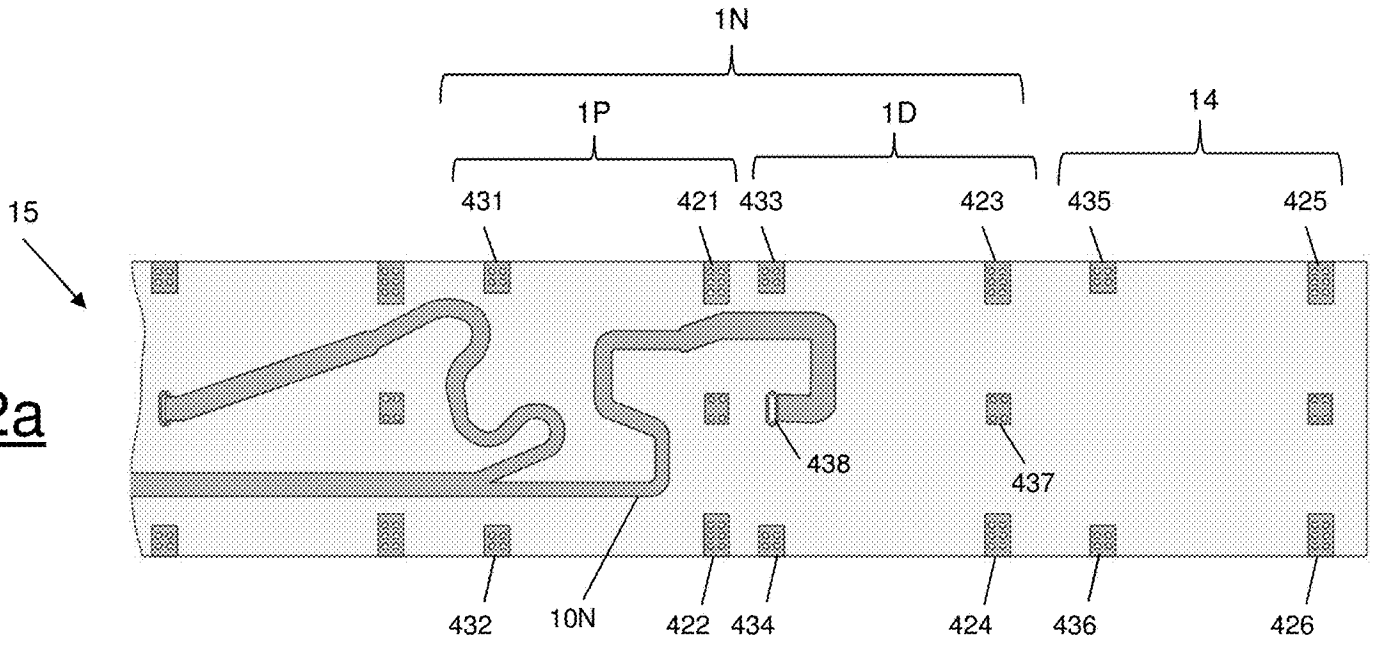
FIGS. 12*a* and 12*b* schematically show the two faces (respectively, face A and face B) of a portion of the supporting PCB according to the other embodiments of the present invention.
Figure 12B:
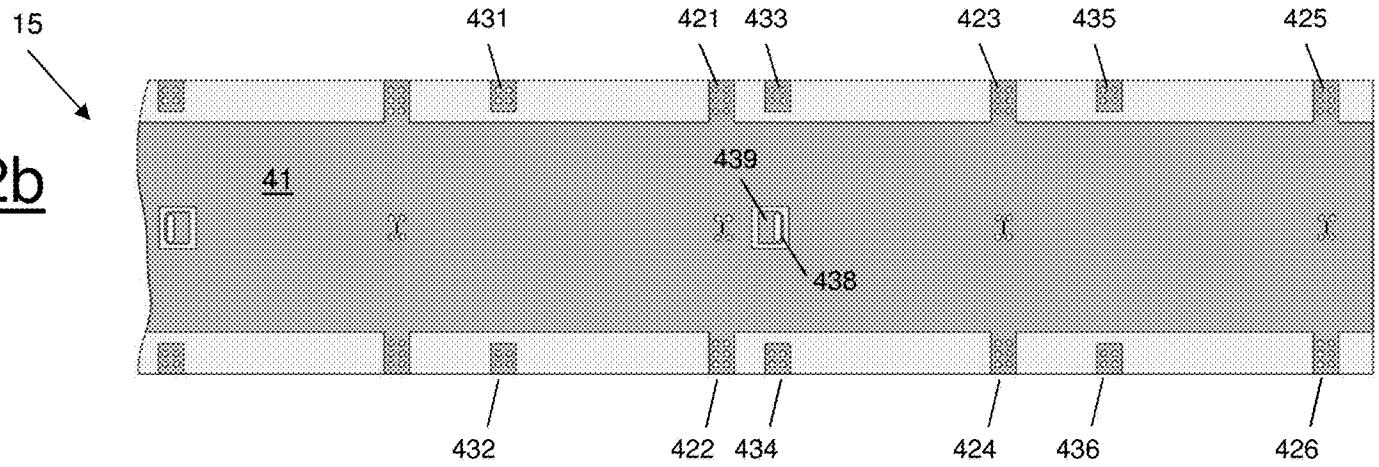
Figure 13:
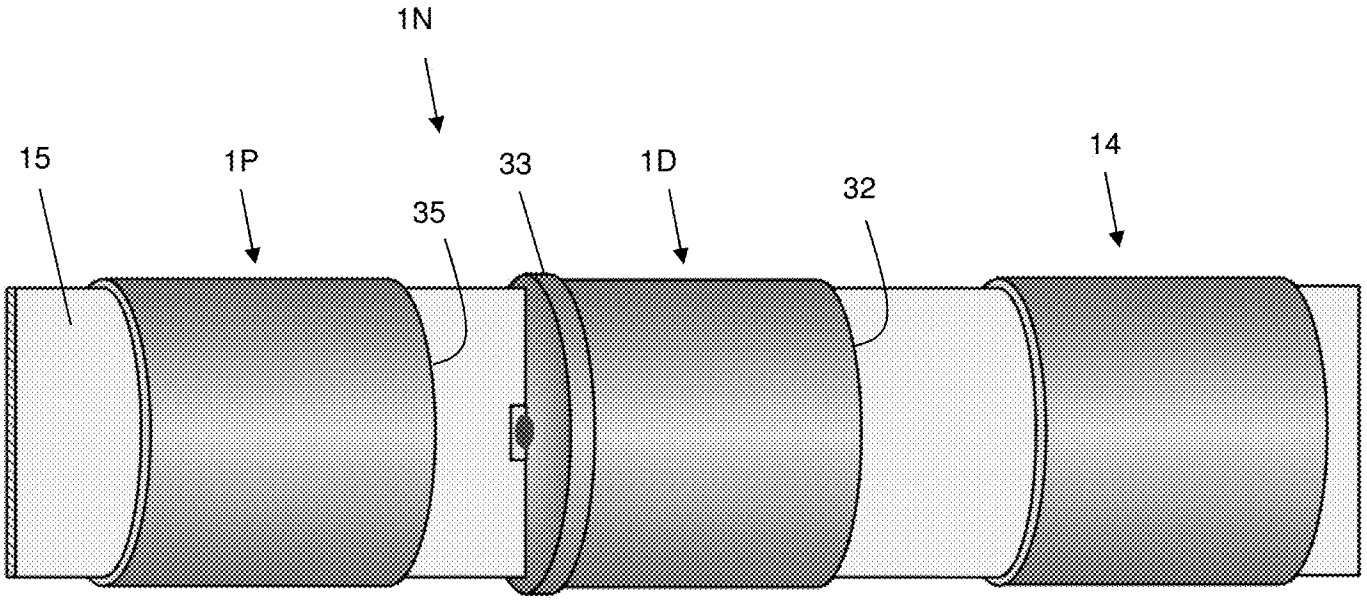
FIG. 13 schematically shows the passive element and the driven element of a dipole and an isolating choke assembled over the supporting PCB.

FIGS. 12*a* and 12*b* schematically show the two faces (respectively, face A and face B) of a portion of the supporting PCB 15 in the area of a dipole (for instance, the N-th dipole or top dipole 1N within the antenna array) and of the isolating choke 14 placed on top of the antenna array. The area of the top dipole 1N is indicated with the same reference number "1N" and the area of the isolating choke 14 is similarly indicated with the same reference number "14". FIG. 13 schematically shows the passive element 1P, the driven element 1D of the considered dipole 1N and the isolating choke 14 assembled over the supporting PCB.

As shown in FIG. 12*a*, face A of the supporting PCB comprises the dipole feeding line 10N for feeding the top dipole 1N.

As shown in FIG. 12*b*, face B comprises a longitudinal central metal trace 41 (e.g. copper) providing the ground plane for the distributed SCN. At both sides of the central metal trace 41, face B comprises a number of grounded anchoring pads (six anchoring pads 421-426 in the exemplary layout of FIG. 12*b*) extending from the central metal trace 41 to the border of the substrate. Each pair of corresponding grounded anchoring pads on both sides of the central metal trace 41 (namely pads 421 and 422, pads 423 and 424, pads 425 and 426) is used to solder a respective element (driven or passive) of the dipole, or the isolating choke. For instance, pads 421 and 422 are used to solder the passive element 1P of the top dipole 1N, pads 423 and 424 are used to solder the driven element 1D of the top dipole 1N and pads 425 and 426 are used to solder the isolating choke 14. Each grounded anchoring pad comprises a number of plated through holes for grounding a corresponding provided on face A of the PCB, as shown in FIG. 12*a*, where the pads are indicated with the same reference numbers.

Face B of the supporting PCB also comprises along the two borders of the substrate, a number of isolated anchoring pads (six anchoring pads 431-436 in the exemplary layout of FIG. 12*b*). Each pair of isolated anchoring pads is used to solder a respective element. For instance, pads 431 and 432 are used to solder the passive element 1P of the top dipole 1N, pads 433 and 434 are used to solder the driven element of the top dipole 1N and pads 435 and 436 are used to solder the isolating choke 14.

Furthermore, face A of the PCB comprises, for each element of the dipole and for the isolating choke, a respective central grounded anchoring pad 437 provided with plated through holes. Each of these pads is used to solder a cap of the respective element, i.e. the top end cap of the driven element, the end cap of the passive element and the end cap of the isolating choke.

Besides, face A of the PCB comprises a feeding bonding pad 438 connected to the feeding line 10N for feeding the considered dipole, e.g., in this exemplary case, top dipole 1N. The feeding bonding pad 438 on face A corresponds to a feeding bonding pad on face B of the PCB, which is indicated with the same reference number 438. The two pads are connected by means of a metallized transversal slot in the substrate. The feeding bonding pad 438 on face B comprises also a short pad 439 for impedance matching and is surrounded by a metal-free area.

The elements (passive and driven) of a dipole, for instance, the top dipole 1N, according to these embodiments of the present invention have a same structure as already described above for the first embodiment, as schematically shown in FIG. 13. In particular, each element has a cylindrical body. Each driven element 1D as then two caps, a top end cap 32 and a bottom end cap 33, while each passive element 1P has a single end cap 35. The top end cap 32 of the driven element 1D, the end cap 35 of the passive element 1P and the end cap of the choke 14 have a similar structure, which is the structure already described above with reference to FIG. 5*b*. In particular, the top end cap 32 of the driven element 1D, the end cap 35 of the passive element 1P and the end cap of the choke 14 are soldered to the supporting PCB on both faces thereof, at two diametrically opposite positions and at a central position, as already described above. Moreover, when assembled on the PCB, the cap has four remaining openings of substantially rectangular shape allowing the passage of the optional metal tube that isolates and shields the wires supplying current to the obstruction lamps. If present, such metal tube lies on face B of the PCB and is soldered to the end caps. The openings of the cap are also suitable to allow the passage of the coaxial cable feeding the SCN according to the third and fourth embodiments of the present invention and, possibly, the coaxial cable connecting one section of the SCN to another section according to the fourth embodiment of the present invention. As already anticipated above, also these coaxial cables lie on face B of the supporting PCB.

The bottom end cap 33 of the driven element 1D has a structure substantially similar to the top end cap of each driven element according to the first embodiment (see FIG. 5*a*). In particular, the bottom end cap of the driven element is soldered to the PCB on both faces thereof, at two diametrically opposite positions and at a central position, as already described above. Moreover, when assembled on the PCB, the cap has four remaining openings of substantially rectangular shape allowing the passage of the optional metal tube that isolates and shields the wires supplying current to the obstruction lamps. Moreover, the openings also allow the passage of the coaxial cable feeding the SCN according to the third and fourth embodiments of the present invention and, possibly, the coaxial cable connecting one section of the SCN to another section according to the fourth embodiment of the present invention. As already highlighted above, the feed point of the dipole's driven element is advantageously placed at the center of the bottom end cap.

Figure 14:
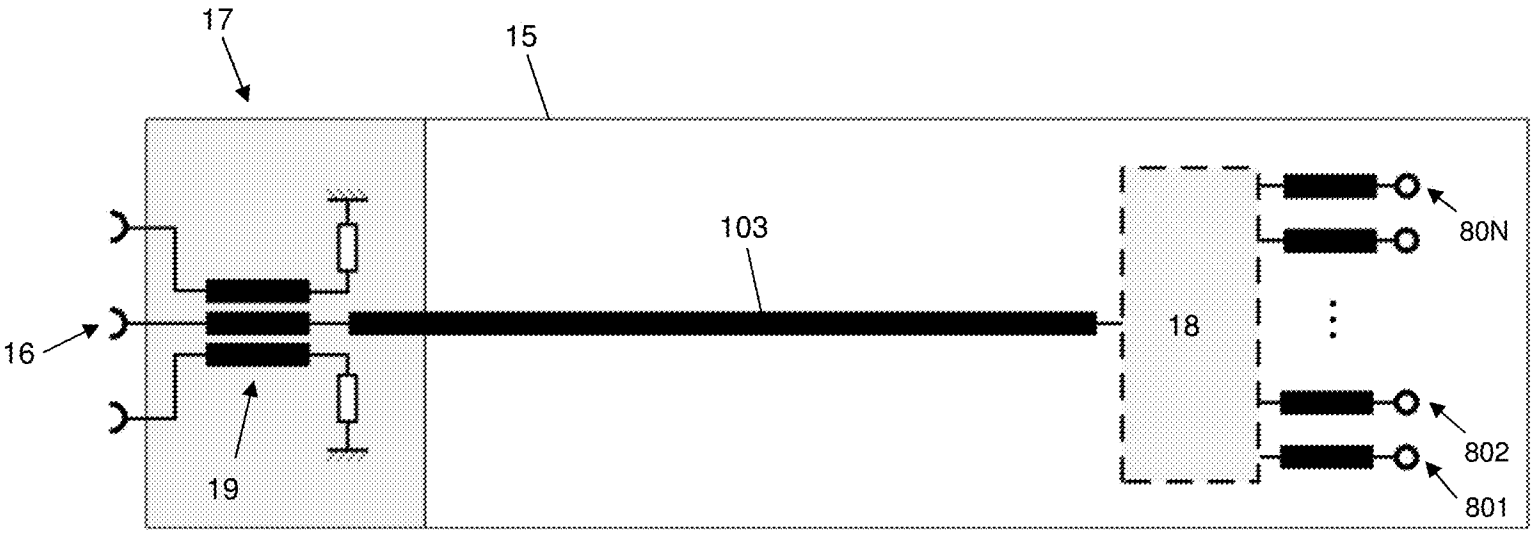
FIG. 14 schematically shows a circuit diagram of the printed distributed SCN and the base of the antenna array according to the second embodiment of the present invention.

FIG. 14 schematically shows a circuit diagram of the printed distributed SCN 18 and the base 17 of the antenna array according to the second embodiment of the present invention. As already disclosed for the first embodiment, the SCN 18 comprises a number N of branches comprising components providing amplitude and/or phase adjustment for the signals fed to the radiating elements, as already described above with reference to FIG. 6. Moreover, in this case, the supporting PCB 15 comprises a printed main feeding line 103 going from the antenna connector to the center of the distributed SCN. Also shown in FIG. 14 are, within the base 17 of the antenna array, the optional directional couples 19. At the boundary of the SCN, a number N of feeding bonding pads 801, 802, . . . , 80N, as described above with reference to FIGS. 12*a* and 12*b*.

Figure 15:
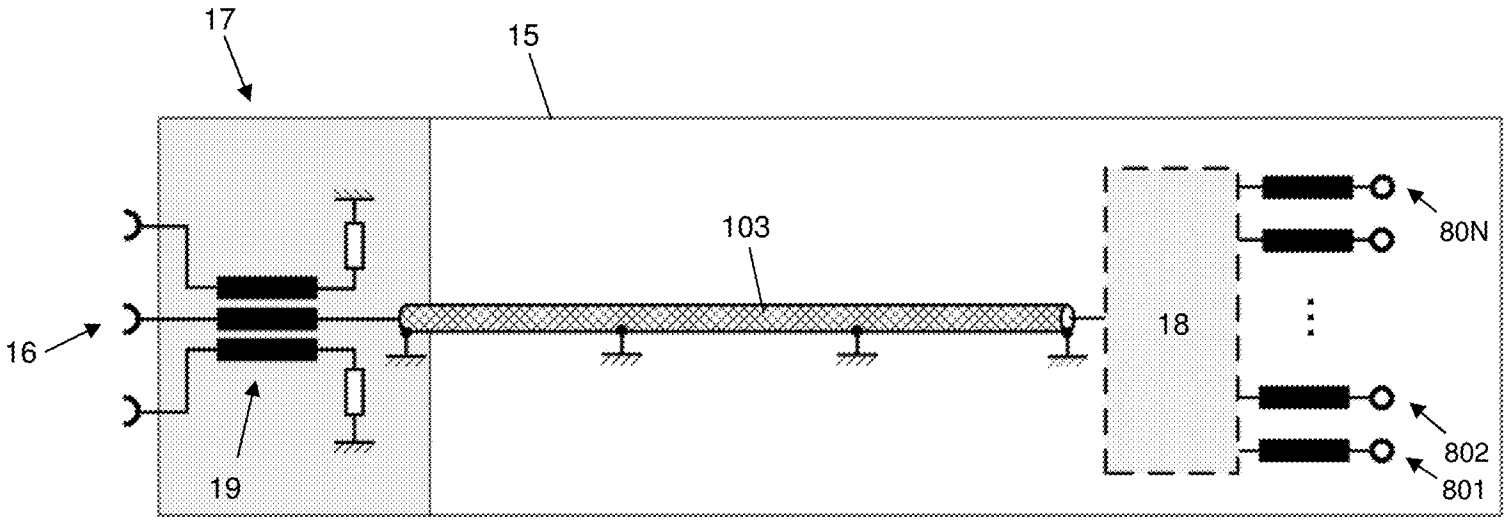
FIG. 15 schematically shows a circuit diagram of the printed distributed SCN and the base of the antenna array according to the third embodiment of the present invention.

FIG. 15 schematically shows a circuit diagram of the printed distributed SCN 18 and the base 17 of the antenna array according to the third embodiment of the present invention. Differently with respect to the second embodiment, the main feeding line 103 is implemented by a coaxial cable which lie on face B of the supporting PCB 15. The distributed SCN lies on face A. In this way, more space is left for the deployment of the SCN traces thus reducing unwanted electromagnetic couplings, which may introduce a distortion in the vertical radiation pattern shape.

Figure 16:
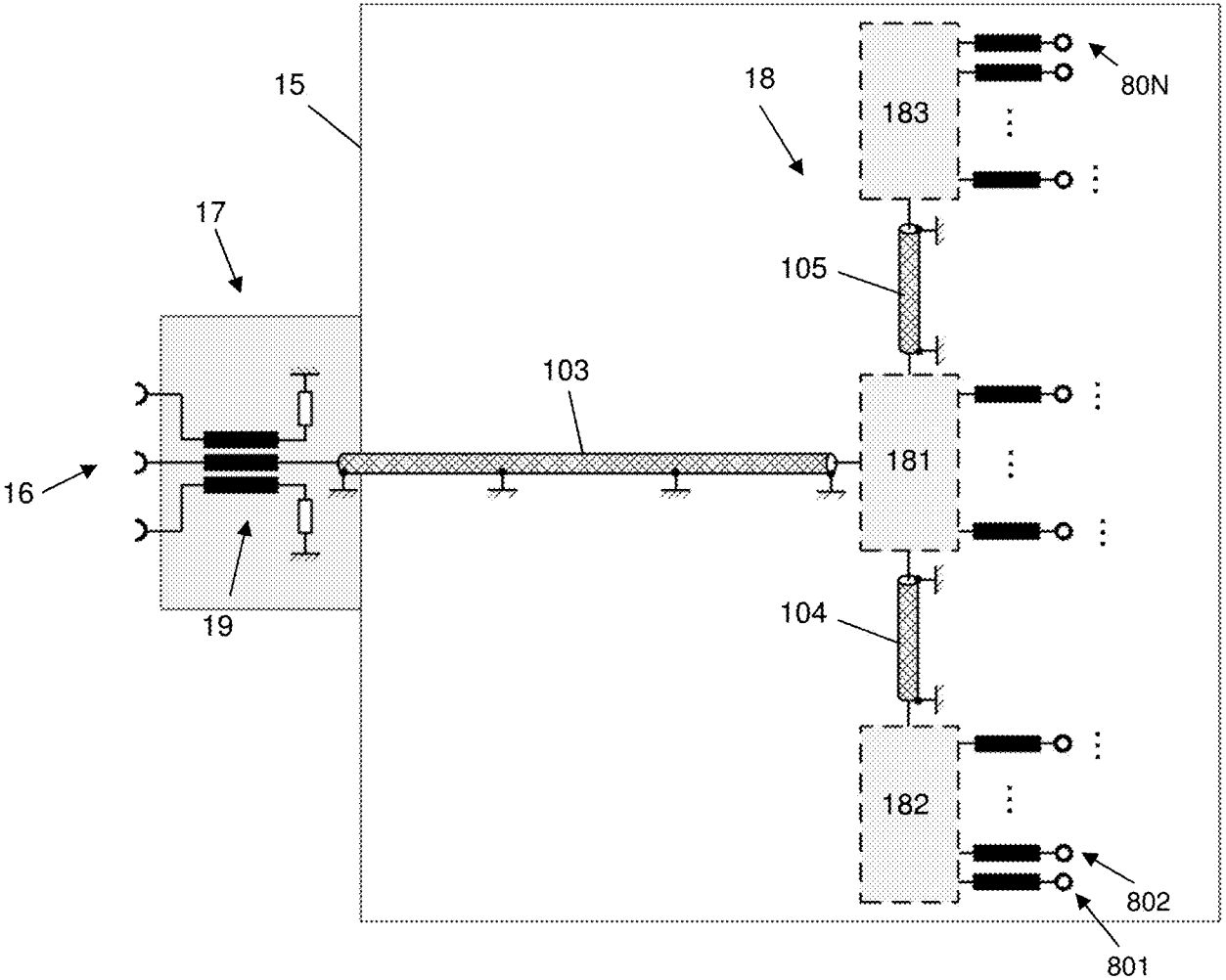
FIG. 16 schematically shows a circuit diagram of the printed distributed SCN and the base of the antenna array according to the fourth embodiment of the present invention.

FIG. 16 schematically shows a circuit diagram of the printed distributed SCN 18 and the base 17 of the antenna array according to the fourth embodiment of the present invention. According to this embodiment the printed distributed SCN 18 is split into a number M of sections, M being an integer number higher than 1, which are connected by means of coaxial cables. In the exemplary circuit schematically shown in FIG. 16, the SCN is split into three sections 181, 182, 183 over the supporting PCB 15. As shown in the Figure, the SCN comprises a first section 181, which is connected to the coaxial cable 103 implementing the main feeding line from the antenna connector 16, a second section 182 and a third section 183. Each of the second and third sections 182, 183 is connected to the first section 181 by means of a respective coaxial cable 104, 105. All the coaxial cables are running over the face of the supporting PCB 15 comprising the ground plane, which is opposite with respect to the face comprising the printed distributed SCN 18. This allows to ensure more space for the traces of the printed distributed SCN over the respective face of the supporting PCB.

The inner conductor of the coaxial cable implementing the main feeding line 103 according to the third and fourth embodiments of the present invention passes through a via hole in the supporting PCB 15 and is soldered on face A to a bonding pad of a trace of an SCN branch (not shown in FIGS. 14-16). The shield of the coaxial cable is soldered on face B of the supporting PCB. The same arrangement is provided to connect a coaxial cable between two sections of the distributed PCB according to the fourth embodiment of the present invention.

It is to be noticed that the shields of the coaxial cables (namely, the coaxial cable implementing the main feeding line according to the third and fourth embodiments and the coaxial cables connecting different sections of the distributed SCN according to the fourth embodiment) are connected to the ground plane of the PCB, as already mentioned above. In particular, each coaxial cable is preferably soldered to the ground plane of the PCB repeatedly, at a number of points regularly spaced over the ground plane. These connections may be repeated at distances approximately one-quarter wavelength long at the center frequency of the operating band of the antenna array. For instance, the coaxial cables can be soldered to the ground plane when they pass through the openings provided in the end caps of the driven and passive elements.

According to the second, third and fourth embodiments of the present invention, the supporting PCB is preferably implemented on a single slab of substrate material. However, according to a variant of these embodiments, the supporting PCB may be split into different slabs of substrate material. These slabs are then connected together by, for instance, soldering metal plates between the ground planes on face B and metal strips between printed lines on face A. This may be advantageous when the substrates present on the market are not sufficiently long and/or when the length of the antenna arrays is not compatible with the maximum sizes that the PCB manufacturer can process.

The antenna base of the antenna array according to the second, third and fourth embodiments of the present invention is substantially similar to the antenna base already described above with reference to the first embodiment of the invention. Differently from the antenna base of the first embodiment, in this case, the internal printed circuit board contains only a section of the main feeding line and the optional directional couplers.

As evident from the above description, the present invention provides omnidirectional antenna arrays with parallel-fed stacked radiating elements showing:

- a greatly improved uniformity of the omnidirectional radiation pattern, important in several applications (e.g. DME);
- reduced production costs.
- reduced total weight, almost halved if compared to similar products on the market.

The number of radiating elements ranges from 2 to N, where N depends on the required gain and radiation pattern characteristics in the vertical plane. All radiating elements are connected to ground from the DC current point of view, avoiding the dangerous accumulation of electrostatic charges.

The antenna array provides a high degree of axial symmetry in the dipoles feed points, ensuring a very regular omnidirectional radiation pattern in the azimuth plane (i.e. an almost constant gain over 360°). This achievement has been obtained by eliminating the central cylindrical supporting pole used in the prior art solutions, substituting it with a flat PCB of suitable width and substrate material. All the cylindrical elements of the antenna (radiators and chokes) are secured to this PCB. The driven elements can thus be fed at their longitudinal symmetry axis (i.e. at substantially the center of their circular end-cap), ensuring a uniform distribution of the RF currents along the surface of the radiating elements.

The radiation pattern in the vertical plane can be optimally shaped (also with null-filling, if required) by suitably "weighting" both the amplitudes and the relative phases of the signals that feed in parallel the dipoles, thanks to a splitting/combing network (SCN) printed on a microstrip (or stripline) substrate of a low-loss dielectric material (e.g. a PTFE-based one) suitable for high frequency applications.

The invention claimed is:

1. An antenna array comprising a number of radiating elements and a supporting elongated flat printed circuit board comprising a substrate and two opposite faces, wherein:

each radiating element is attached to said supporting printed circuit board;

each radiating element is a dipole radiating element having a respective axis of symmetry;

the axes of symmetry of said radiating elements are aligned along a direction parallel to a longitudinal axis of said supporting printed circuit board and lie on a longitudinal plane parallel to a longitudinal center plane of said printed circuit board and located between said opposite faces;

said supporting printed circuit board comprises at least one conductive trace on one of said faces, said conductive trace acting as a ground plane for the radiating elements; and for each radiating element, said supporting printed circuit board carries a respective feeding line to provide a feeding signal to said radiating element at a feed point located on said printed circuit board and substantially belonging to said axis of symmetry, wherein each radiating element comprises a driven element and a passive element, each of said driven element and said passive element being a conductive cylindrical element, wherein said driven element comprises a hollow cylindrical body, a top end cap and a bottom end cap, each of said top end cap and said bottom end cap comprising a respective slot to allow the passage of said supporting printed circuit board, the bottom end cap being soldered to said feed point at a position substantially corresponding to the center of said slot; and said passive element comprises a hollow cylindrical body and an end cap comprising a respective slot to allow the passage of said supporting printed circuit board.

2. The antenna array according to claim 1, wherein said substrate is made of a glass-reinforced epoxy resin.

3. The antenna array according to claim 1, further comprising a splitting/combining network placed at a base of said antenna array, said spitting/combining network being connected to an antenna main port at said base of the antenna array and being configured to process an input signal from said antenna main port to provide respective signals to said radiating elements through individual dipole feeding lines.

4. The antenna array according to claim 3, wherein said dipole feeding lines are equal-length coaxial cables attached to said printed circuit board.

5. The antenna array according to claim 4, further comprising, for each radiating element, a respective impedance-matching unit for matching a characteristic impedance of said coaxial cable to an impedance of said radiating element.

6. The antenna array according to claim 3, wherein said spitting/combining network is printed on a Polytetrafluoroethylene-based substrate.

7. The antenna array according to claim 1, further comprising a splitting/combining network printed on said supporting printed circuit board, said spitting/combining network being connected to an antenna main port at a base of the antenna array by means of a main feeding line printed on said supporting printed circuit board and being configured to process an input signal from said antenna main port to provide respective signals to feed said radiating elements through individual printed dipole feeding lines.

8. The antenna array according to claim 1, further comprising a splitting/combining network printed on said supporting printed circuit board, said spitting/combining network being connected to an antenna main port at a base of the antenna array by means of a main feeding line comprising a coaxial cable attached to said supporting printed circuit board and being configured to process an input signal from said antenna main port to provide respective signals to feed said radiating elements through individual printed dipole feeding lines.

9. The antenna array according to claim 8, wherein said splitting/combining network is split into at least a first section and a second section, said first section being connected to said main feeding line coming from said base of the antenna array, said second section-being connected to said first section by means of a coaxial cable, wherein said first section is configured to provide respective signals to feed a first group of said radiating elements through individual a first group of printed dipole feeding lines and said second section is configured to provide respective signals to feed a second group of said radiating elements through a second group of individual printed dipole feeding lines.

* * * * *